US009803436B2

(12) United States Patent
Richardson

(10) Patent No.: US 9,803,436 B2
(45) Date of Patent: Oct. 31, 2017

(54) INTEGRATED CASING DRIVE

(71) Applicant: WARRIOR RIG LTD., Calgary (CA)

(72) Inventor: Allan Stewart Richardson, The Woodlands, TX (US)

(73) Assignee: Warrior Rig Technologies Limited, Calgary, CA (US)

( * ) Notice: Subject to any disclaimer, the term of this patent is extended or adjusted under 35 U.S.C. 154(b) by 632 days.

(21) Appl. No.: 14/064,103

(22) Filed: Oct. 25, 2013

(65) Prior Publication Data

US 2014/0131052 A1 May 15, 2014

Related U.S. Application Data

(60) Provisional application No. 61/718,284, filed on Oct. 25, 2012.

(51) Int. Cl.
*E21B 19/16* (2006.01)

(52) U.S. Cl.
CPC ..... *E21B 19/16* (2013.01)

(58) Field of Classification Search
CPC ..... E21B 19/16; E21B 19/164; E21B 3/02
See application file for complete search history.

(56) References Cited

U.S. PATENT DOCUMENTS 1,745,094 A * 1/1930 Hild ..... E21B 19/08 173/151
4,494,072 A * 1/1985 Jeter ..... E21B 17/003 175/321
4,529,045 A * 7/1985 Boyadjieff ..... E21B 19/02 173/141
4,800,968 A * 1/1989 Shaw ..... E21B 19/02 166/66.5
5,107,940 A * 4/1992 Berry ..... E21B 7/023 175/122
5,388,651 A * 2/1995 Berry ..... E21B 19/16 175/113
6,443,241 B1 9/2002 Juhasz
7,096,977 B2 8/2006 Juhasz
7,140,443 B2 11/2006 Beierbach
7,191,840 B2 3/2007 Pietras
7,350,586 B2 4/2008 Guidry
7,377,324 B2 5/2008 Beierbach
2002/0043403 A1* 4/2002 Juhasz ..... E21B 19/00 175/40
2004/0216924 A1* 11/2004 Pietras ..... E21B 19/00 175/57
2009/0084537 A1* 4/2009 Rudshaug ..... E21B 3/02 166/77.51
2010/0132955 A1* 6/2010 Storm, Jr. ..... E21B 23/02 166/377
2011/0114387 A1* 5/2011 Belcher ..... E21B 17/042 175/57
2015/0107385 A1* 4/2015 Mullins ..... E21B 19/06 74/89.42

* cited by examiner

*Primary Examiner* — Robert E Fuller
*Assistant Examiner* — Steven MacDonald
(74) *Attorney, Agent, or Firm* — Oyen Wiggs Green & Mutala LLP

(57) ABSTRACT

An integrated casing drive system combines a top drive having a rotary drive portion, a pipe handler having a casing gripper wherein the pipe handler is rotationally mounted to the top drive, and a selectively actuable casing drive lock for locking the rotary drive portion to the pipe handler.

41 Claims, 21 Drawing Sheets

Normal Mode

ICD Mode

INTEGRATED CASING DRIVE

CROSS-REFERENCE TO RELATED APPLICATIONS

This application claims priority to U.S. provisional patent application No. 61/718,284 filed Oct. 25, 2012, entitled Integrated Casing Drive.

FIELD OF THE INVENTION

This invention relates to the field of top drives and in particular to a top drive accessory, referred to herein as an integrated casing drive, which may form part of a system which includes a top drive having a slewing pipe handler and tubular gripper.

BACKGROUND OF THE INVENTION

At least three top drive manufacturers and at least two third-parties offer a top drive accessory known as a Casing Running Tool (herein a CRT). CRT's attach, directly or indirectly, to the top drive quill and enable the top drive (hereinafter also referred to as a "TD") to hoist, rotat e and circulate casing without screwing into it, which is advantageous as explained below. A CRT grips and seals either on the outside or the inside of the casing.

In the prior art, applicant is aware of Tesco™ U.S. Pat. Nos. 7,140,443 and 7,377,324, and Tesco's related products; National Oilfield Volant™ (NOV) U.S. Pat. Nos. 6,443,241 and 7,096,977, and NOV's related products; Canrig™ U.S. Pat. No. 7,350,586 and Canrig's related products; Weatherford™ U.S. Pat. No. 7,191,840 and Weatherford's related products.

Basic casing operations are similar with or without the use of a top drive. Slip-type elevators are generally required to hoist more than 200 tons casing string weight. In conventional casing running operations, the traveling equipment (TD or not) only hoists the casing, with no rotational capability. Rotation for make-up is provided by a casing tong at the floor. An internally sealing packer (e.g. a Tam Packer™) may be installed on the TD quill to selectively seal inside the casing to facilitate circulation. Conventional casing running operations can only make up a casing joint; there is no capability to rotate the casing string.

Casing adaptor nubbins have been used to rotate and/or circulate casing with top drives. These are simple crossovers between the TD quill (or drillstem valve or sub) and the upper casing connection. They allow the top drive to screw into the top of the casing approximately like any drilling tubular. But it is a serious disadvantage to screw into the casing because the well owners do not want to risk any damage to the sensitive casing threads because it could compromise the integrity of the well.

The reasons well owners wish to rotate and circulate casing with the TD are known to those skilled in the art and are well covered in the CRT prior art references above, and are incorporated herein by reference.

The CRT's work reasonably well but have the following drawbacks:

a) They are expensive to purchase or to hire.
b) Although required only occasionally, they are not widely available as a service or rental.
c) They are quite complex.
d) They are separate tool to rig-up and commission.
e) They need additional load path certification & periodic re-certification requirements.

f) Heavy casing loads are transmitted through the TD's quill load path. Consequently, further drawbacks include:
   i. Strength safety factors of rotary connections are typically marginal for casing loads.
   ii. Rotary connections are susceptible to cyclic fatigue effects.
   iii. Drillstem valves and subs with connections matching the drill pipe typically have to be removed for the casing operation because of hoisting capacity limitations.
   iv. Rotary connections cannot carry significant bending loads so they are very sensitive to misalignment during the hoisting of heavy casing loads, while typically contributing to a very stiff load path with no alignment forgiveness.

Top Drives may advantageously include a rotatable pipe handler section which includes: a gripper capable of clamping tubulars immediately below the TD (also called wrenches, back-up wrenches and grabbers by the various manufacturers); and, elevator links supported by structural elements capable of transmitting the elevator load directly or indirectly to the hoisting equipment (typically a traveling block).

Most top drives of which applicant is aware in the relevant class have rotatable pipe handlers for the primary purpose of actuation of the corresponding link-tilt in any plan-view orientation.

A rotatable pipe handler normally has a static or stator section anchored to the TD frame and a rotatable or rotor section containing or mounted to the elevators, elevator links and supporting structure, the link tilt actuator and the gripper. The rotatable section is typically guided on the static section by a rolling-element slewing bearing or by bushings. The rotatable pipe handlers of which applicant is aware have a capability to rotationally lock the rotatable section to the static section or the TD frame using a pipe handler lock. The pipe handler lock may include pins, tooth-engaged locks and self-locking worm gears. The locks may or may not be remotely controlled.

Many of the rotatable pipe handlers have an independently powered rotation capability, remotely controlled from the operator's station, for the pipe handler rotate function. The pipe handler rotate function typically turns the pipe handler slowly (5-10 RPM) and with very limited torque capacity (2000-3000 ft-lb max). Most of such conventional rotatable pipe handlers have a fluid rotary union (also known as rotary manifold) to transmit for example hydraulic energy (which is most common) from the static section to the rotatable section for actuation of the link tilt, gripper, etc. Elevator hoisting loads (axial) are either transmitted from the rotatable section to the static section via a thrust bearing or bushing or are transmitted from the rotatable section to the TD main shaft (quill or spindle) via a load shoulder.

SUMMARY OF THE INVENTION

The integrated casing drive, herein also referred to as an ICD, according to the present specification allows a top drive to transmit rotational energy to tubulars, such as casing without screwing into the casing, for the purposes of: making up the casing, rotating the casing string while running it into the hole, rotating the casing string during cementing, and casing drilling. As used herein, the term, casing, is intended to include other forms of tubulars.

The integrated casing drive according to one aspect provides a means to selectively connect the gripper to the primary or main rotary drive of the TD for the purpose of rotating a casing or other tubular. The gripper clamps near the top end of the casing or other tubular and can then rotate the casing or other tubular without screwing into the top of the casing or other tubular.

The present invention ICD works in conjunction with a top drive having a main shaft or quill rotary drive and a rotary union thereunder from which depends a selectively rotatable pipe handler having a gripper. As used herein, the phrase: "rotatable energy coupling" (herein also REC) is defined to mean any one of the following that transfers energy across a rotating coupling for powering the pipe handler gripper, etc, including but not limited to: fluid (eg. hydraulic, pneumatic) rotary union or rotary manifold, electric slip ring, or inductive coupling, or advantageously as described in applicant's U.S. patent application Ser. No. 13/669,419, publication no. 2013/0055858, referred to herein and incorporated by reference.

The ICD may be characterized in one aspect as including a selectively releasable ICD lock (for example, akin to a pipe handler lock) for locking the rotation of the pipe handler to the rotation of the main shaft or quill or corresponding main rotary drive in the top drive (herein collectively referred to as the top drive rotary drive portion) to thereby simultaneously rotate a length of casing held in the gripper with driven rotation of the rotary drive portion, without a threaded connection being made between the top drive quill and the length of easing.

In a first embodiment, not intended to be limiting, the conversion of the stator between its normal rigidly fixed mode, rigidly fixed to the top drive frame, within which frame a main drive sprocket is rotated by top drive motor(s) mounted on the frame, and its integrated casing drive mode wherein the stator is unlocked from the top drive frame and instead locked to, for rotation with, the main drive sprocket, is accomplished using a mode-shift mechanism (MSM). An ICD locking assembly may in one embodiment form part of the MSM, so that, in a drive sense it functions to lock, the stator and the main drive sprocket. The ICD locking assembly locks to the stator and is unlocked from the main drive sprocket for normal operation of the REC, and is unlocked from the stator and locked to the main drive sprocket for engaging the integrated casing drive.

In the locked or normal operation mode, the stator is thus fixed to, so as to form part of the fixed portion of the REC. The REC works to transfer energy between the fixed and rotating components while allowing rotation of the pipe handler. In the integrated casing drive mode, the stator is fixed to the main drive sprocket for rotation therewith and unlocked from the fixed portion of the REC, and so, in fact, is no longer a stator at all. Thus rotation of the main drive sprocket directly rotates the pipe handler and its gripper. The locking of the stator to the main drive sprocket may be provided by using merely bushings or bearings or the like which normally allow the pipe handler to rotate, and then using a suitable lock such as an ICD lock (also referred to herein as a casing drive lock) of the kind described herein, or as otherwise would be known to one skilled in the art to provide the requisite locking function, or for example such as a pipe handler lock, or for example using locking members as would be known to one skilled in the art such as pins, shafts, locking dogs, teeth-engaging segments, or other lock members to lock the stator to the main drive sprocket.

In one embodiment, not intended to be limiting, the locking assembly is mounted on, for example, an ICD plate as described below, and the lock may be a shuttle lock of the form wherein a pin or other elongate rigid member (collectively referred to herein as a pin) which is biased by a pin actuator for translation between for example raised and lowered positions, so as to lock the REC when the pin is in its ICD mode for the operation of the integrated casing drive.

In one embodiment, not intended to be limiting, the lock actuator may be an actuating shaft, or threaded jacking screw in threaded engagement with the lock member. A plurality of lock members may be provided. Manual or automated actuators may be provided. Stops may be provided to limit translation of the lock members. The translation of the lock members may be vertical, although again this is not intended to be limiting as other orientations of the lock members would work.

Advantageously a sensor such as a proximity sensor is provided to detect and confirm the positioning of the locking members into the locking member's normal or ICD mode position.

In a second embodiment, the mode shift mechanism includes a selectively engageable casing drive lock engageable between the rotor and the rotary drive portion directly, so as to lock rotation of the rotor relative to the rotary drive portion when the mode shift mechanism is in the casing-drive mode.

The casing-drive lock may include a locking member positionable and actuable to engage the rotary drive portion. The rotary drive portion may have at least one aperture, and the locking member is actuable to engage in the aperture when the mode shift mechanism is in its casing drive mode.

In view of the two embodiments provided by way of example herein, the present invention may in one aspect be summarized as an integrated casing drive system and a method for making, assembling or using same, which includes a top drive having a rotary drive portion, a pipe handler having a casing gripper wherein the pipe handler is rotationally mounted to the top drive, and a selectively actuable casing drive lock for locking the rotary drive portion.

An integrated easing drive system combines a top drive having a rotary drive portion driving rotation of a drill string engagement piece, a pipe handler having a gripper wherein the pipe handler is rotationally mounted to the top drive, and a selectively actuable casing drive lock for locking the rotary drive portion to the pipe handler.

DETAILED DESCRIPTION OF EMBODIMENTS OF THE INVENTION

Figure 1:
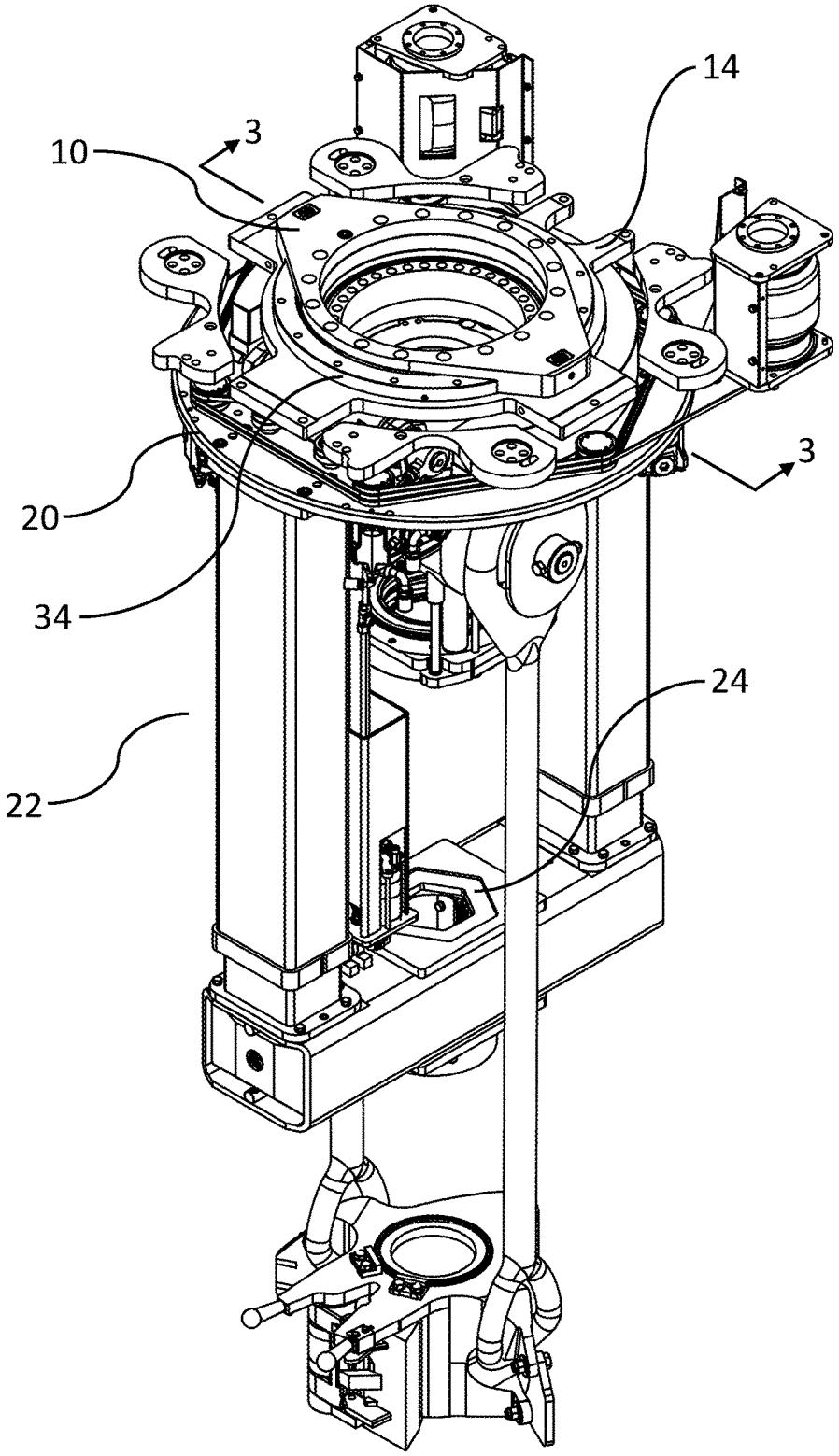
FIG. 1 is a top perspective view of the ICD plate mounted on top of the stator plate and stewing power transmission, from which depends the pipe handler. The tilt link actuators are not shown.
Figure 2:
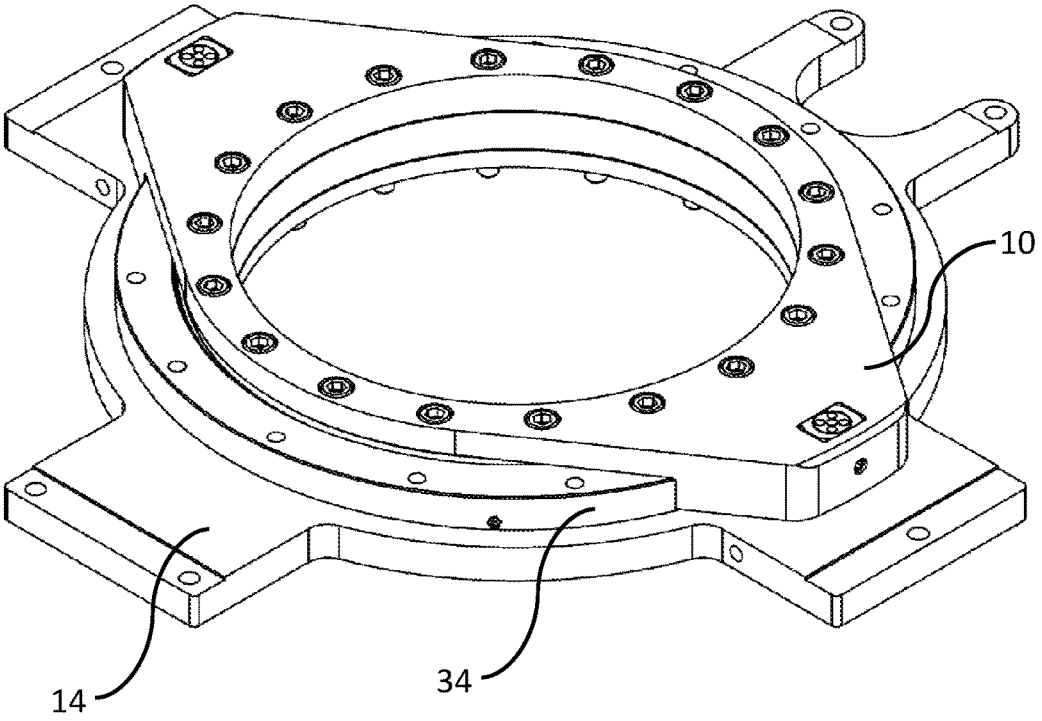
FIG. 2 is an enlarged perspective view of the ICD plate and stator plate of FIG. 1.
Figure 3:
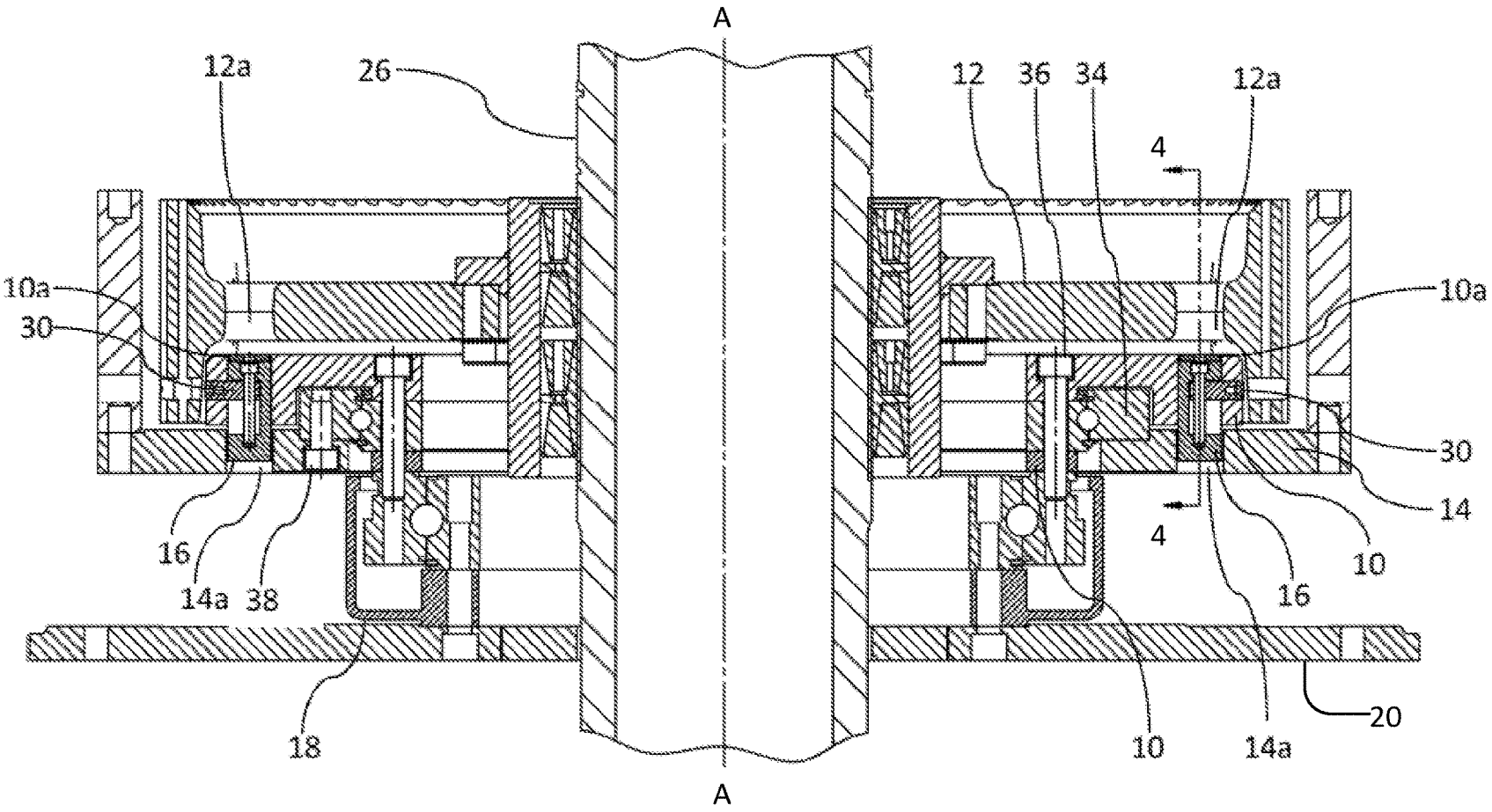
FIG. 3 is a sectional view along line 3-3 in FIG. 1.
Figure 4:
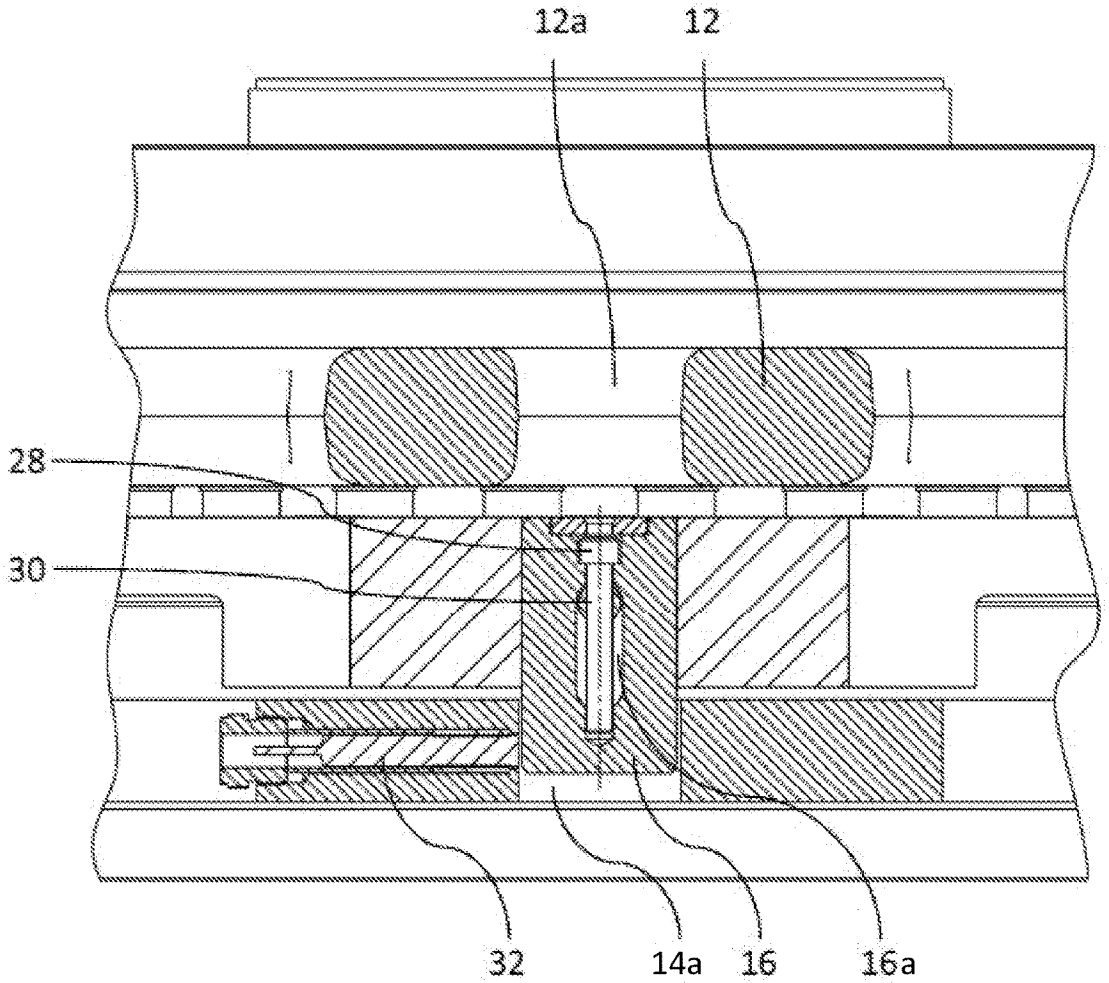
FIG. 4 is a sectional view along line 4-4 in FIG. 3.

The integrated casing drive (herein also referred to as an "ICD") according to one embodiment which is not intended to be limiting, cooperates with a top drive (TD) and includes a mode-shift mechanism (MSM) such as for example the ICD plate 10 of FIGS. 2-4. ICD plate 10 may, for example, cooperate in an intermediary position between top drive main sprocket 12 and stator 14. Stator 14 may, as illustrated, be a stator plate. The MSM shifts the ICD between the normal operating mode of the TD and its pipe handler 22, and an ICD mode.

The MSM includes locking members as herein broadly defined. In FIGS. 3 and 4 the locking members are a pair of locking pins 16 which selectively shuttle between raised and lowered positions. Pins 16 are shown lowered so as to lock ICD plate 10 to stator 14 (i.e. in normal TD operating mode). When raised, pins 16 lock into main sprocket 12 (i.e. into ICD mode).

Figure 5:
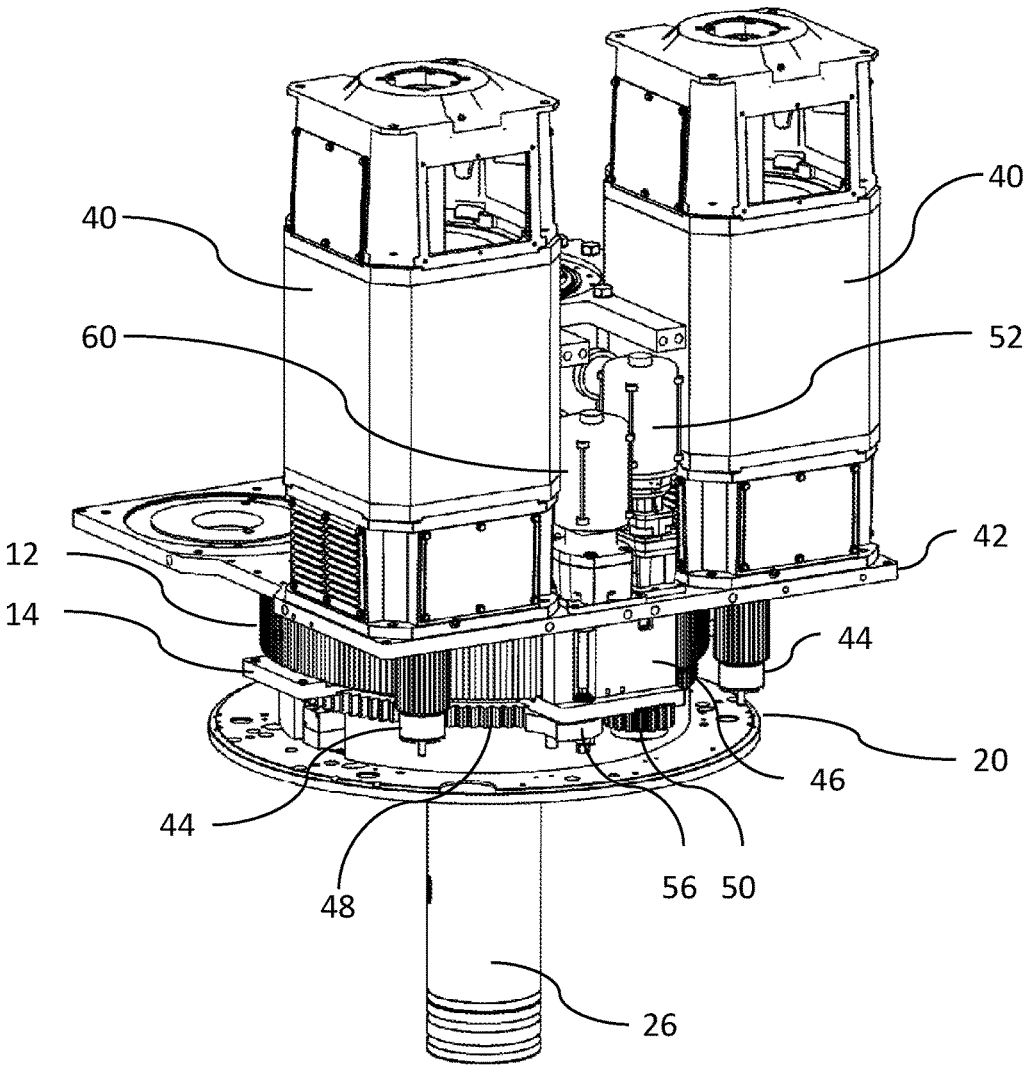
FIG. 5 is, in top perspective partially cut away view, a top drive incorporating a further embodiment of an integrated casing drive.
Figure 6:
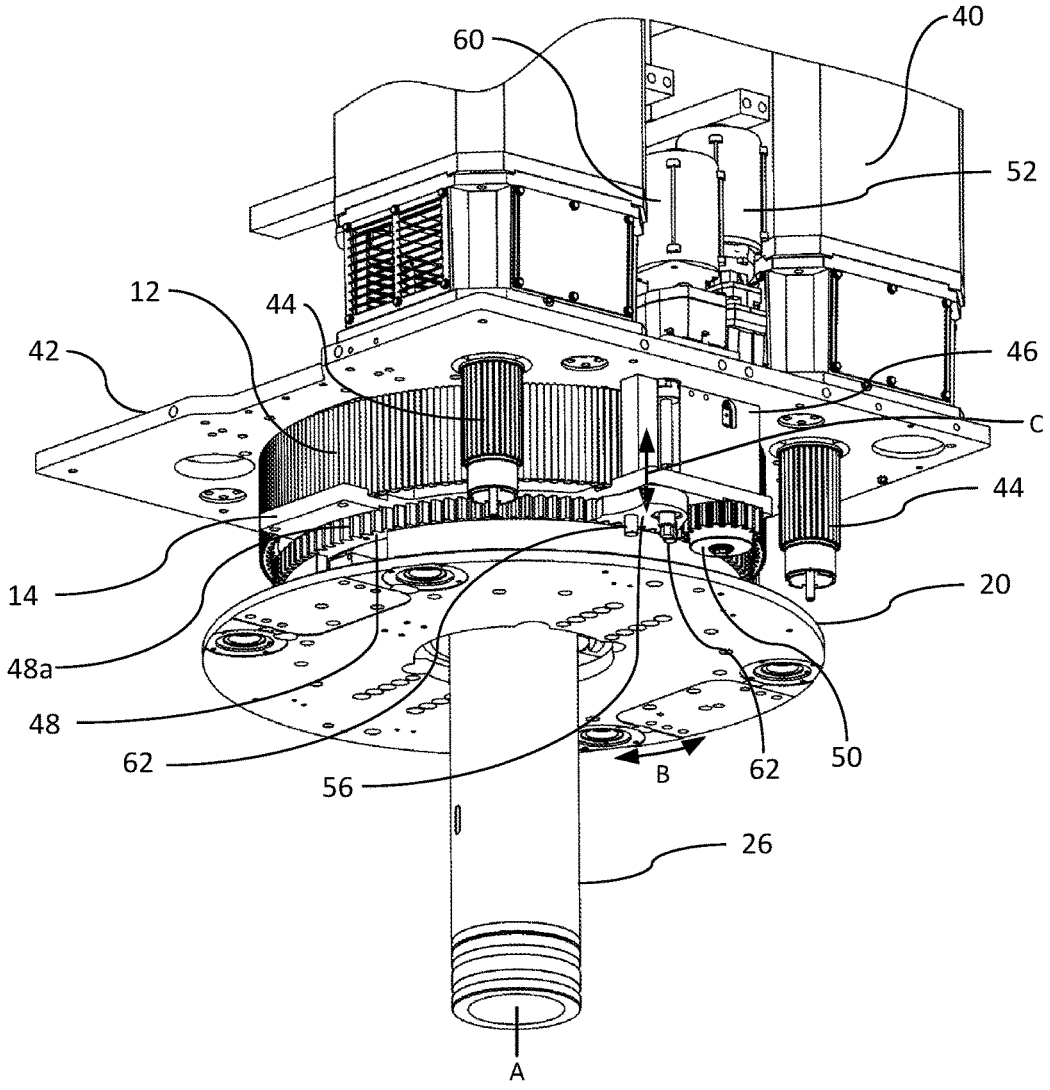
FIG. 6 is the top drive and integrated casing drive of FIG. 5 in a bottom perspective view wherein rotation of the pipe handler rotate spur-gear is locked.
Figure 7:
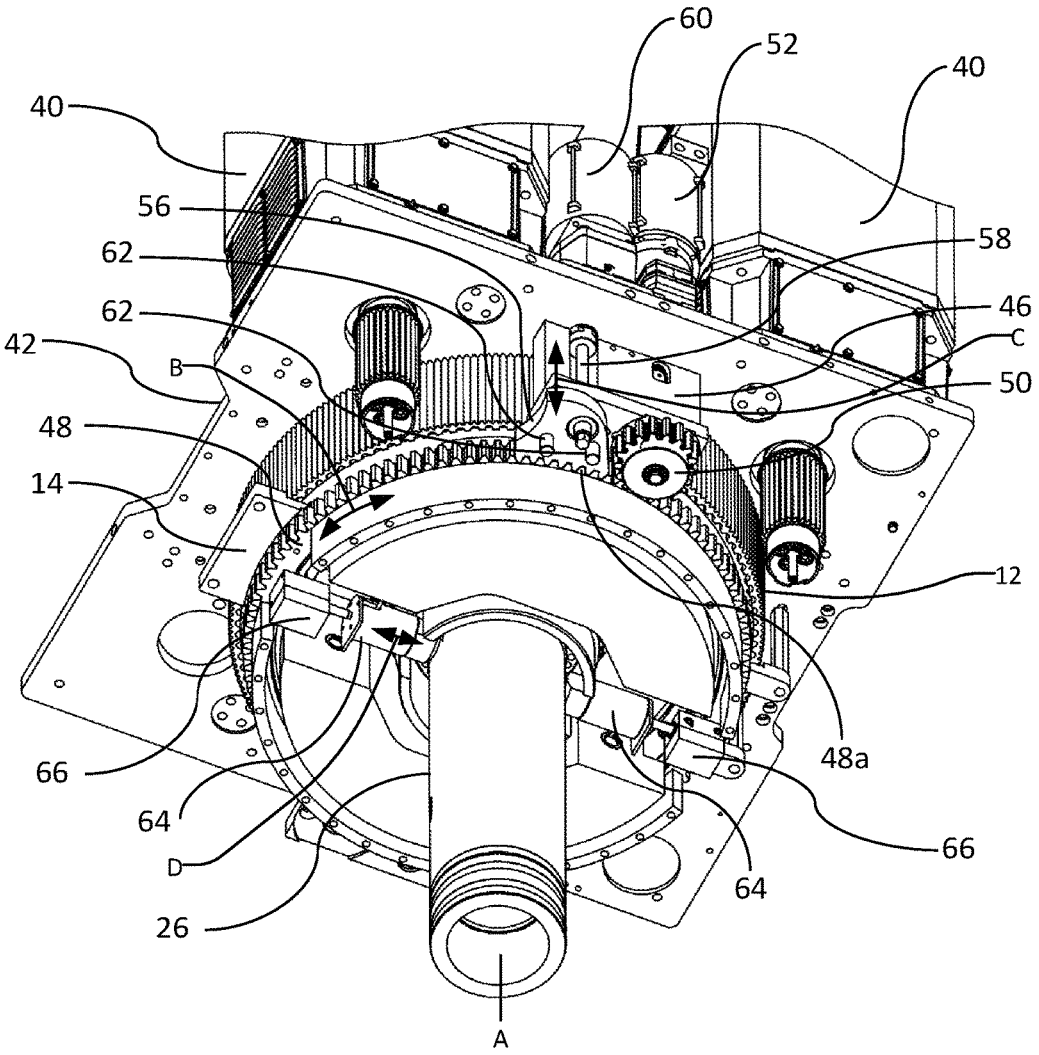
FIG. 7 is a further cut away view of the top drive and integrated casing drive of FIG. 6 wherein the rotor has been cut away to expose the integrated casing drive locks.
Figure 8:
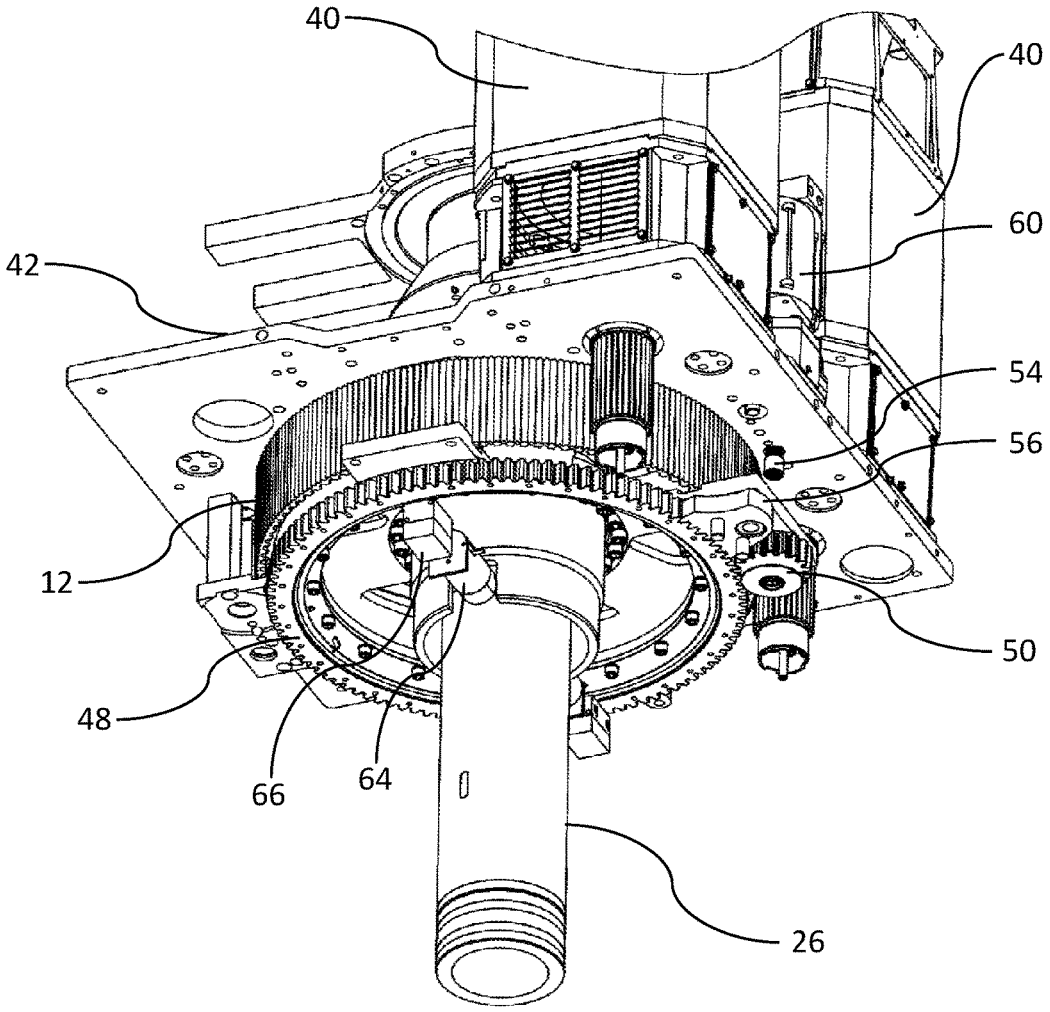
FIG. 8 is the top drive and integrated casing drive of FIG. 7, further cut away to remove the hydraulic fluid reservoirs and to remove a bridge piece, locking dog jack screw and pinion gear shaft.
Figure 9:
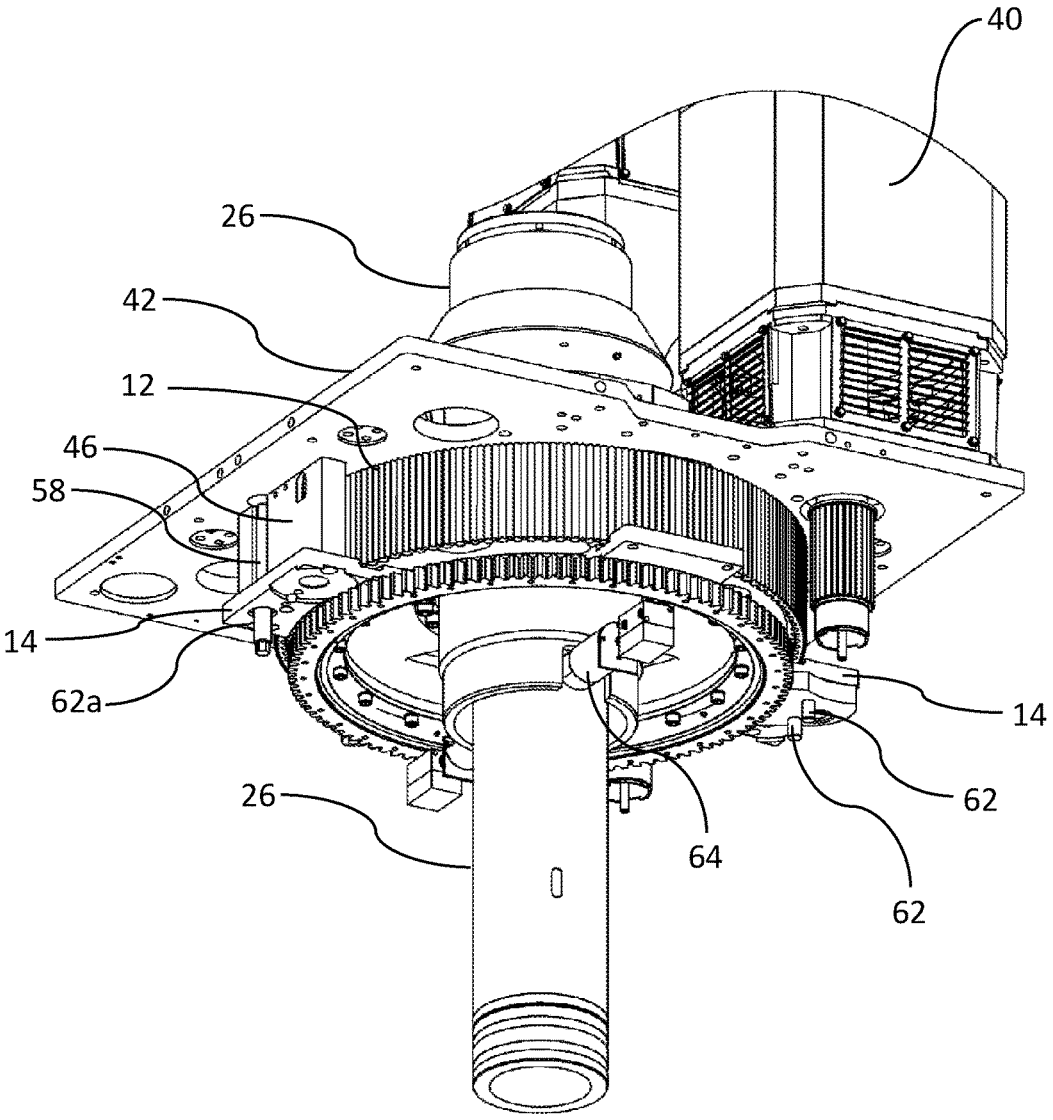
FIG. 9 is the top drive and integrated casing drive of FIG. 8, further cut away to remove one main TD drive motor and the auxiliary motors for the locking dog and pinion gear, wherein the locking dog and pinion gear have been removed and the corresponding bridge-piece and jack screw replaced from the previous views, and wherein the ICD lock housing has been removed.
Figure 10:
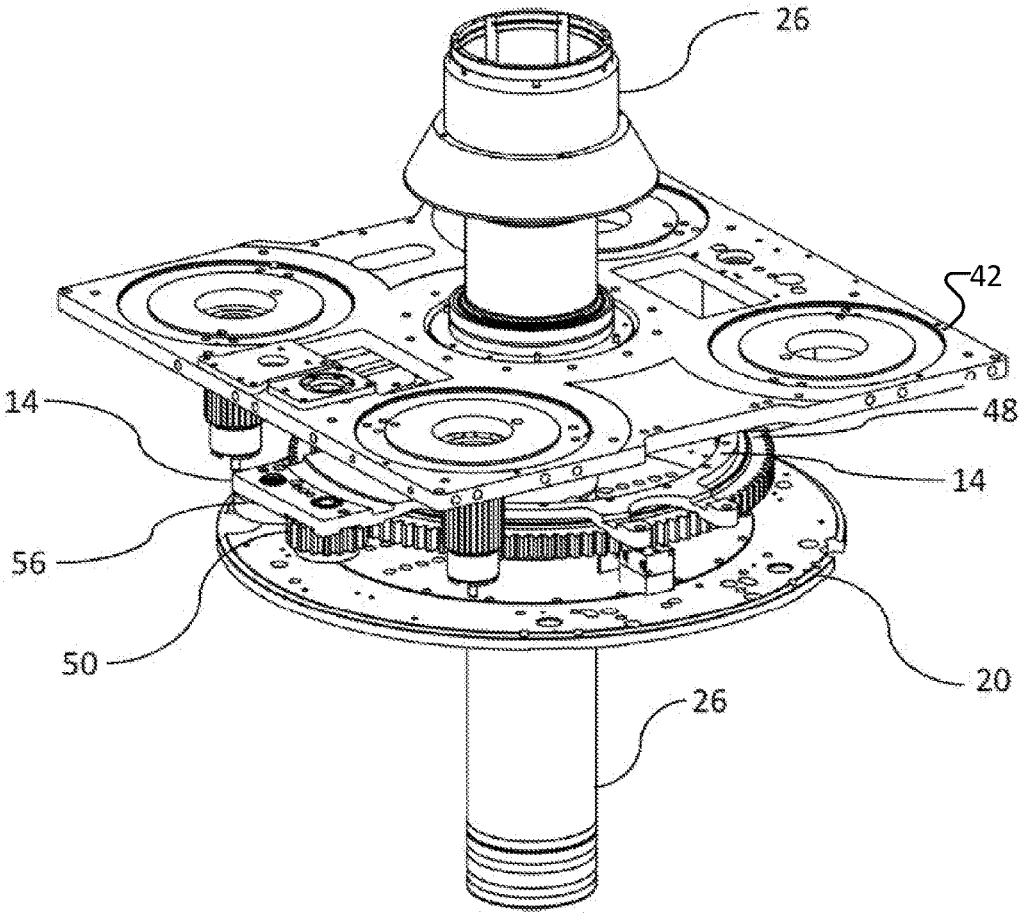
FIG. 10 is the top drive and integrated casing drive of FIG. 9 in a top perspective view and further cut away to remove the drive motors, the main drive sprocket, the bridge pieces, and to replace the rotor from the previous views.
Figure 11:
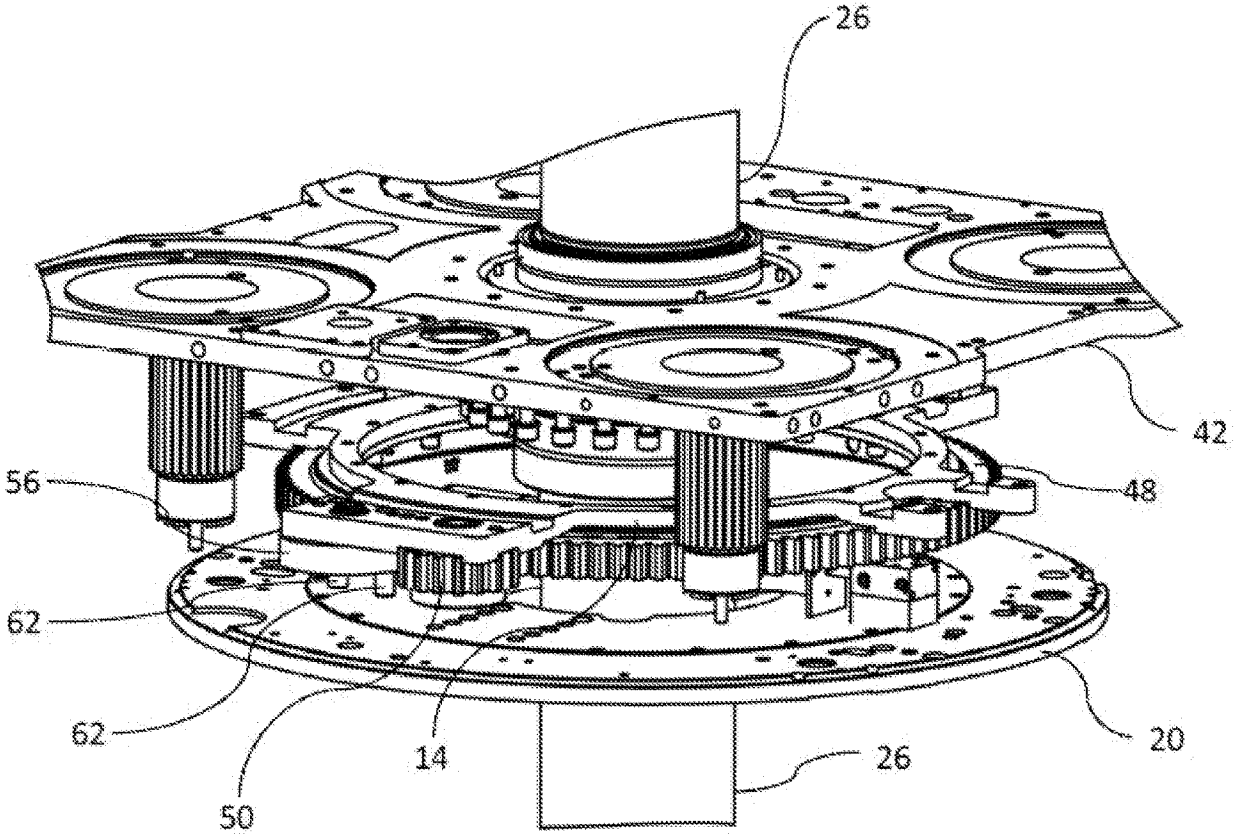
FIG. 11 is an enlarged, partially cut away view of the top drive and integrated casing drive of FIG. 10.
Figure 12:
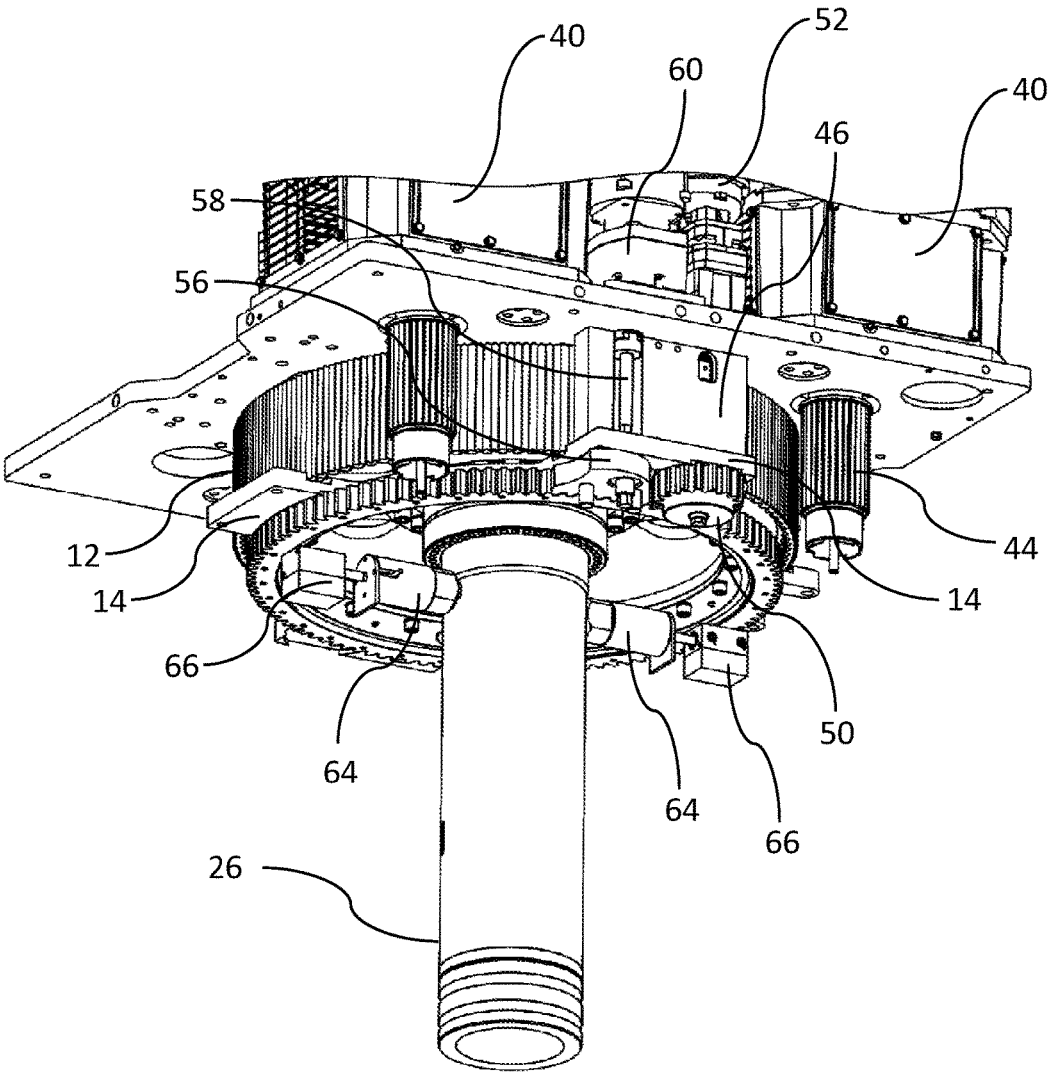
FIG. 12 is the top drive and integrated casing drive of FIG. 7 wherein the hydraulic fluid reservoirs and corresponding spacer side-walls have been removed, and wherein a further embodiment of the ICD lock has been substituted for the ICD lock of FIG. 7, so as to show the ICD locking member mounted on a linear actuator, and wherein the ICD lock is in ICD mode so as to lock the rotor to the spindle.

In ICD mode, that is with ICD plate 10 locked to main sprocket 12, rotation of main sprocket 12 by the top drive motor(s), for example drive motors 40 seen in FIG. 5, causes corresponding simultaneous rotation of slewing drive 18. Assuming slewing drive 18 is locked or otherwise disabled from slewing motion about axis A, rotor 20 will also rotate. Pipe handler 22 is mounted to, so as to depend downwardly from rotor 20. A gripper 24 is mounted to pipe handler 22. In this fashion a casing tubular held within gripper 24 is rotated by the rotation of the top drive main sprocket 12, without the casing tubular being threaded into, and without the use of any prior art tool being mounted onto the quill.

In the illustrated embodiment of FIGS. 3 and 4, not intended to be limiting, pins 16 translate vertically, that is, parallel to the spindle axis A within corresponding bores including bore 14*a* on stator 14, bore 10*a* on plate 10, and bore 12*a* on main sprocket 12. The translation of pins 16 is selectively actuated by jacking screws 28 threadably engaging cross-pins 30 which slide within slots 16*a*. The length of slots 16*a* govern the extent of vertical translation of pins 16.

A proximity sensor 32 may be provided to positively detect when the pins 16 are lowered into their normal mode, i.e., the normal mode of operation of the top drive.

A slewing bearing 34 may be mounted between ICD plate 10 and stator 14. ICD plate 10 may be mounted to slewing bearing 34 and slewing drive 18 by means of bolts 36. Stator 14 may be mounted to slewing bearing 34 by means of bolts 38.

The casing tubular or casing string is hoisted via the normal elevator and link system. Either slip-type or collar-type elevators may be used. The elevator link tilt actuators are not shown.

Slewing bearing 34 selectively allows the normally (i.e., in normal mode) static section, stator 14, of the pipe handler to turn relative to the frame of the TD.

For normal operations, locking pins 16 rotationally connect the normally static section, stator 14, of the pipe handler to the frame of the top drive. This is functionally identical to a conventional rotatable pipe handler, and operates in what is referred to herein as its normal mode.

For casing operations (ie, in ICD Mode), the ICD pins 16 are shifted up to connect the normally static section, stator 14, of the pipe handler to the TD main drive sprocket 12. Pins 16, or other lock members, may also lock to a bull gear on a gear-driven machine, or alternatively directly to other components of the rotary drive portion. Rotational energy can then be transmitted from the TD main drive, for example via sprocket 12, to pipe handler 22 via the ICD pins 16 (or such other locking members as may be employed).

Although only two ICD pins 16 are shown, any number could work. One could also use any type of clutch (e.g. without intending to be limiting a disk or drum) actuated by means known to one skilled in the art (e.g. manual, pneumatic, hydraulic, electric). It is intended that reference herein to a lock or lock member or locking member is intended to include locks, latches, clutches, or other means known in the art to effectively mate the rotor into its ICD mode so as to rotate simultaneously with rotation of the rotary drive portion of the TD.

Note that in FIGS. 3 and 4, in ICD mode, the entire pipe handler 22 turns with the main drive sprocket 12, including both the 'static' section of the pipe handler (which conventionally would be static, i.e. non-rotational relative to the frame), and the rotatable sections.

The gripper 24 may be actuated to clamp the casing tubular so that it turns with the pipe handler.

Figure 16A:
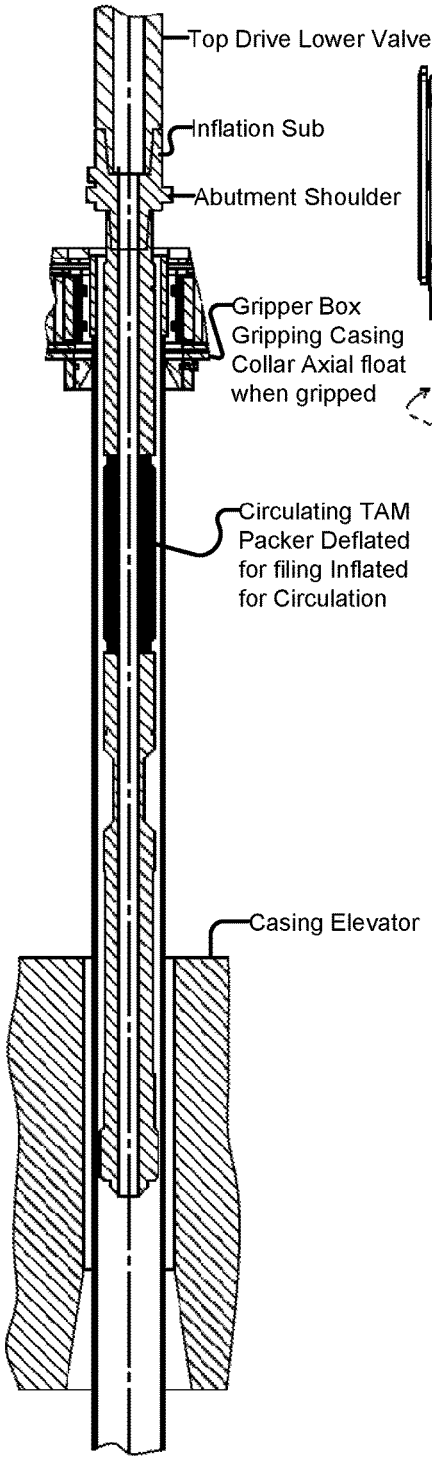
FIG. 16A is a partially cut away enlarged sectional view of the top drive lower valve, an inflation sub having an abutment shoulder, the gripper including gripper box gripping the casing collar, a circulating packer, the casing, and the casing elevator.
Figure 16B:
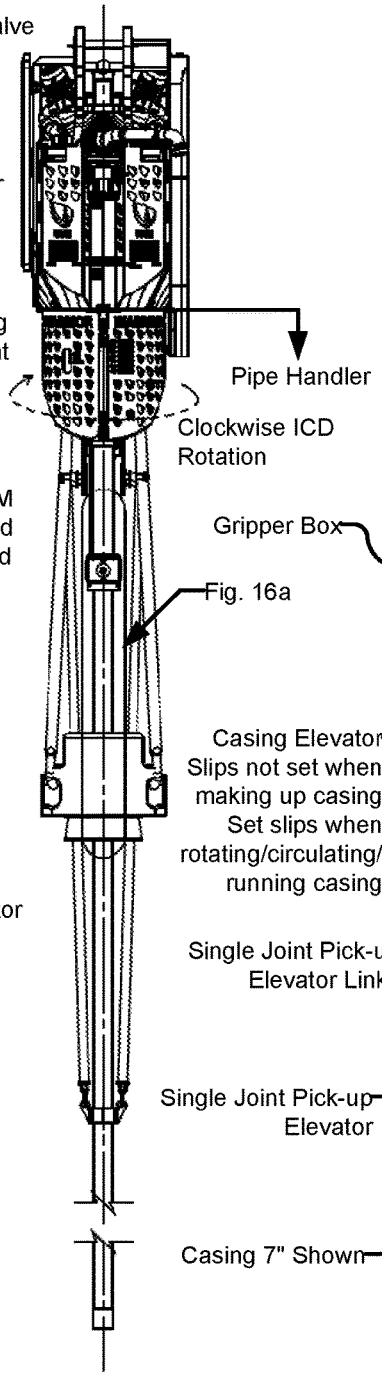
FIG. 16B is, in front elevation view, one embodiment of a top drive having an integrated casing drive and wherein a pipe handler is mounted underneath the top drive, and wherein the pipe hander has a gripper and wherein the view includes casing, a casing elevator, elevator links, and a pickup elevator.
Figure 17:
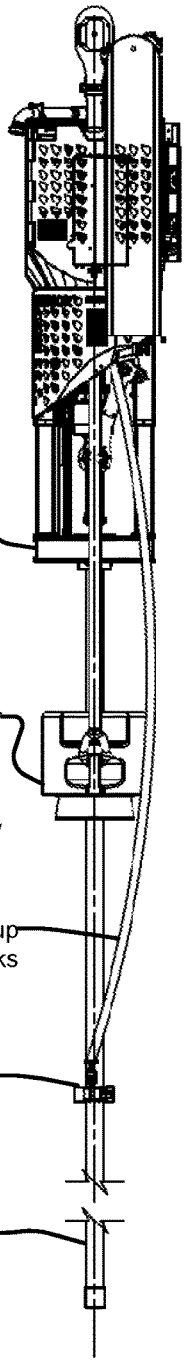
FIG. 17 is, in side elevation view, the top drive pipe handler, casing, casing elevator, elevator links, and pickup elevator of FIG. 16B.

The elevators which co-operate with the TD such as shown in FIGS. 16A, 16B, and 17, can be open or released (slip-type) for making up a joint of casing. The elevators can also be closed or engaged (slip-type) to support the weight of the entire casing string while rotating. In either case, the gripper, casing tubular(s) and elevators rotate in unison.

Rotary power for easing operations is theoretically limited only by the drive capacity of the TD (1000 horsepower (HP) typical) but would normally be restricted to the order of 30 RPM and the maximum make-up torque of the casing (typically <20,000 ft-lb).

The gripper has axial float capability to accommodate casing thread advance and axial deflections under hoisting loads. An internally sealing conventional packer (e.g. a Tam Packer™); may be used to facilitate circulation, The casing size is limited to the gripper maximum opening diameter, for example 9-⅝ inch casing. An auxiliary casing gripper may be provided for any larger casing sizes.

Torque instrumentation is provided by the normal top drive rotary drive system. The system may also include an optional load cell, which may be mounted at the pipe handler lock, or the functional equivalent to measure the reaction between the static and rotatable sections of the pipe handler.

Incorporated by reference herein is applicant's U.S. patent application Ser. No. 13/669,419 entitled "Top Drive With Slewing Power Transmission" filed Nov. 5, 2012, and published 7 Mar. 2013 under publication number 2013/0055858. That application discloses an REC of a type referred to herein as an SPT coupling. The description of such SPT couplings are incorporated herein by reference, and in any event, as now published, are taken to have been reviewed and understood by those skilled in the art. Such a Slewing Power Transmission is advantageous for the Integrated Casing Drive if it avoids the disadvantages of fluid rotary unions typical of most other rotatable pipe handlers. Typical fluid rotary unions present the following challenges:

a) The rotary union seals are capable of slow rotary speeds (5-10 RPM typical) with extremely intermittent duty. They cannot reliably withstand the rotary speed and duty requirements of a casing drive, especially if Grip pressure is high while rotating. This would be especially important for the Casing Drilling application.

b) The rotary unions typically have substantial friction, of a magnitude significant compared to casing make-up torques. This makes accurate torque instrumentation very difficult.

Note that the rotary unions are disadvantageous but may work for an integrated casing drive.

Similar functionality may also be achieved by coupling the rotatable section of the Pipe Handler to the main shaft of the TD (spindle or quill) so that the rotatable section is driven by the. TD motors, and using the best available rotary union seal technology, restrict rotary speeds as required. Unload grip pressure at the rotary union once the gripper is clamped Apply an empirical correction to the torque instrumentation to account for rotary union friction.

Figure 18:
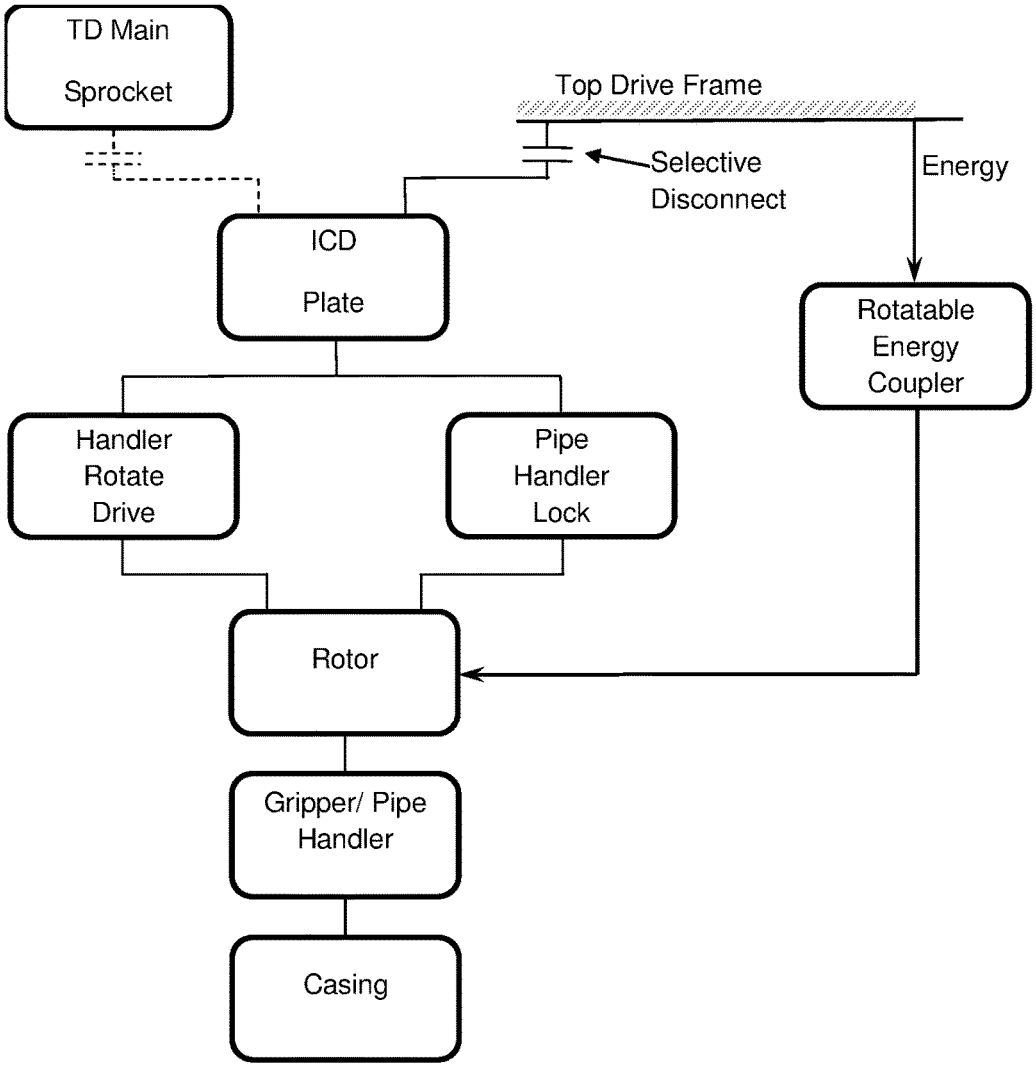
FIG. 18 is a diagrammatic illustration of the operation of a ID and pipe handler in normal operation.
Figure 19:
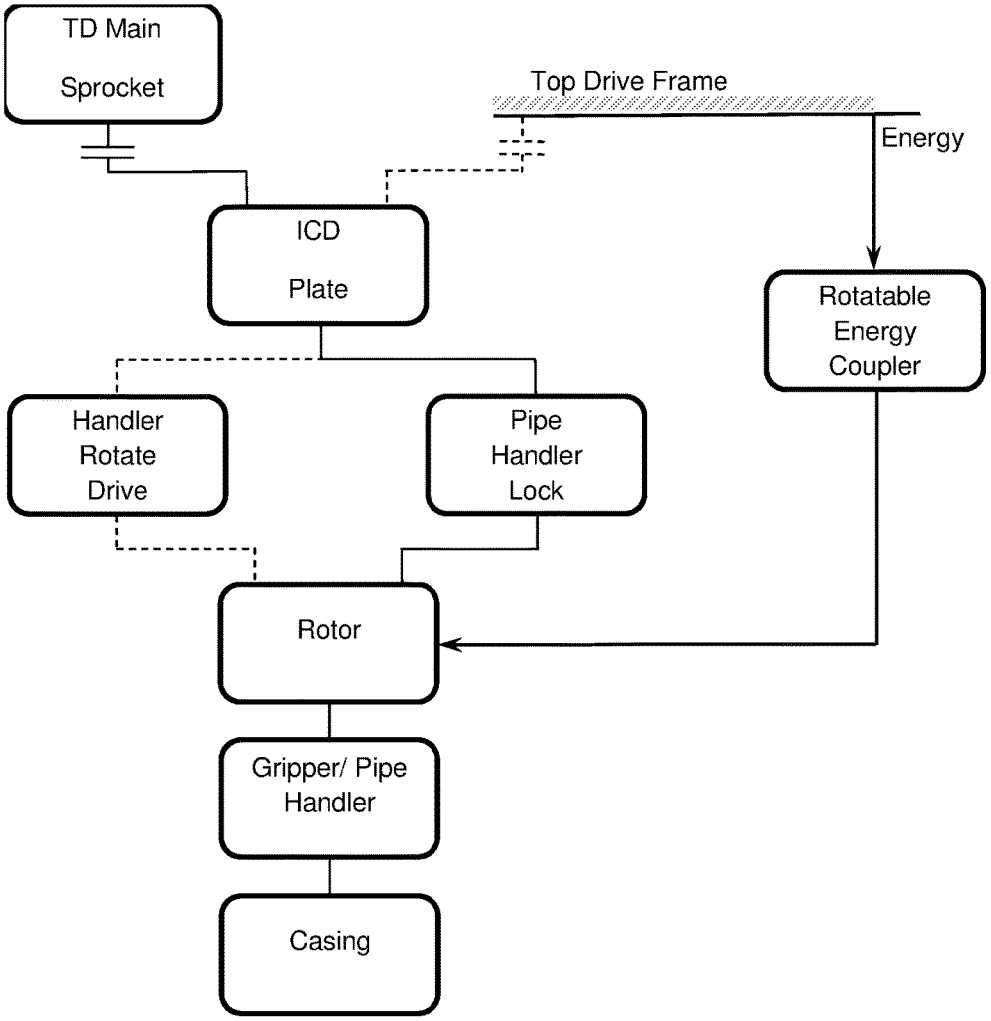
FIG. 19 is the illustration of FIG. 18 showing the diagrammatic operation of the TD and pipe handler in ICD mode.
Figure 20:
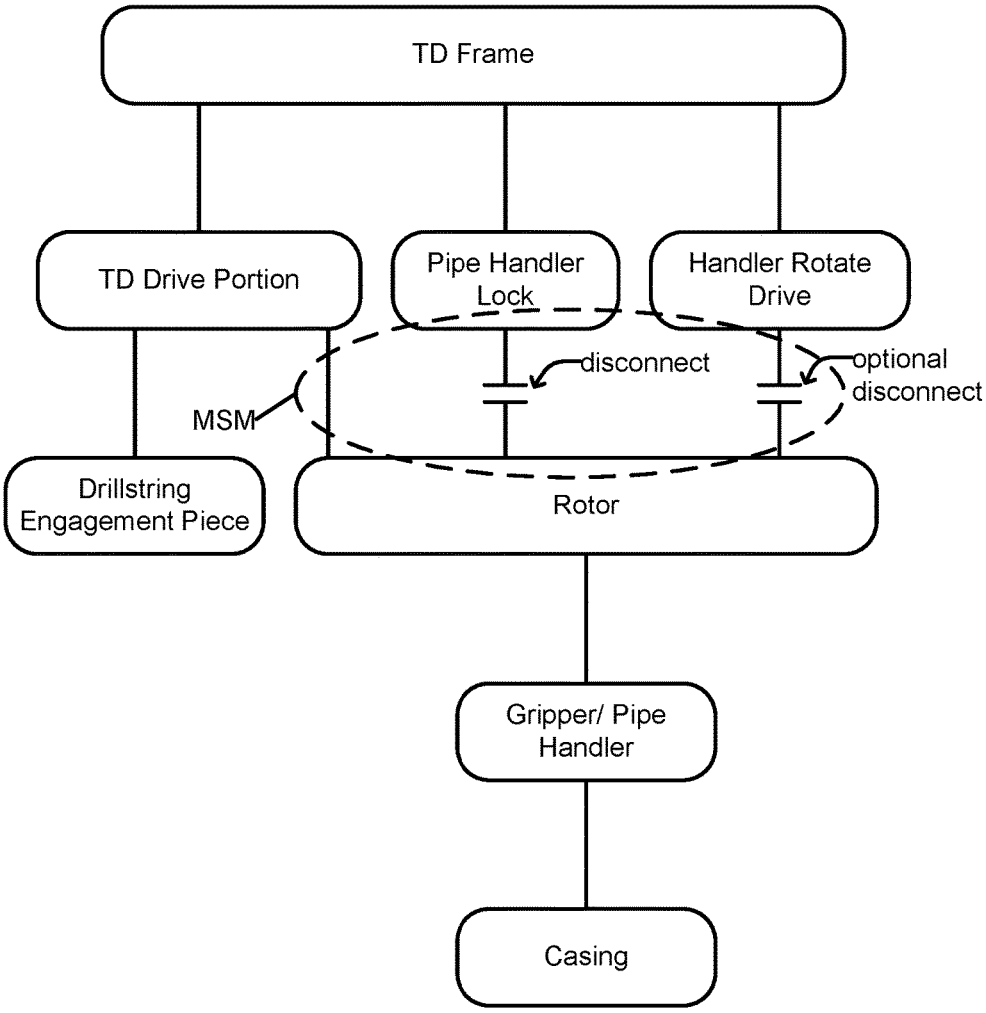
FIG. 20 is a diagrammatic illustration of an embodiment wherein, in ICD mode, the rotor is driven by the top drive rotary drive portion.
Figure 21:
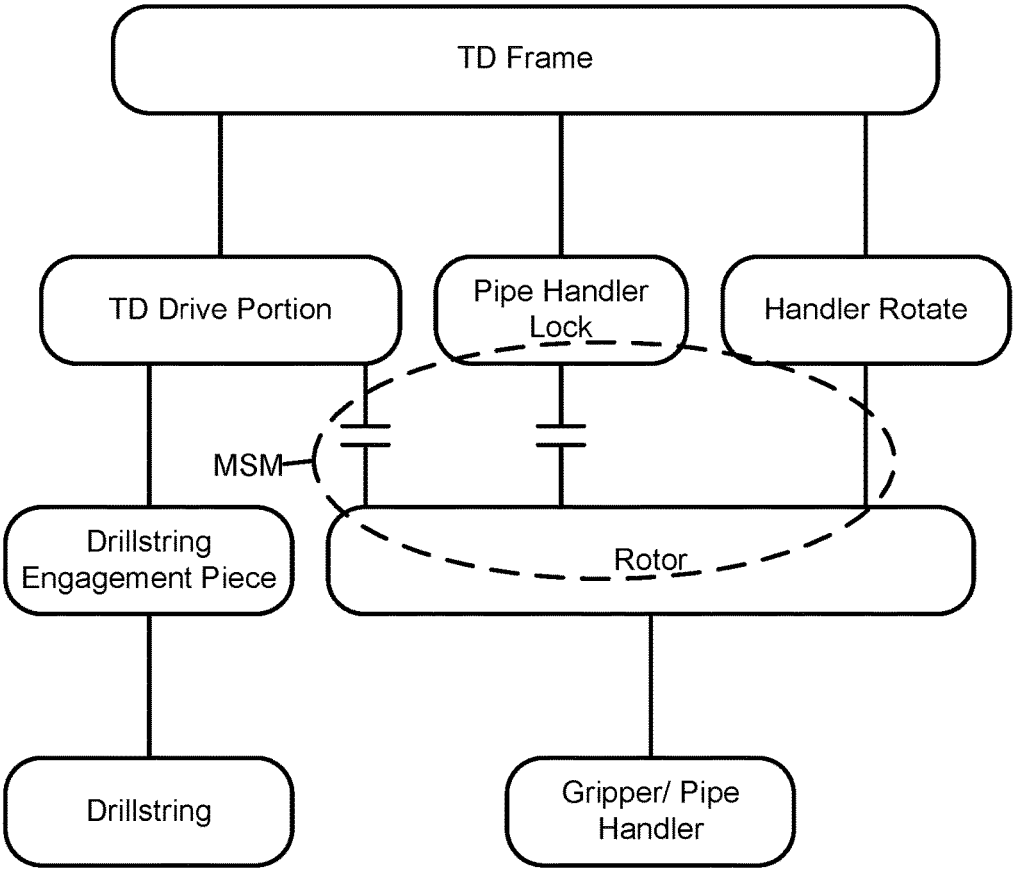
FIG. 21 is a diagrammatic illustration of an embodiment, such as depicted in FIG. 14, wherein, in normal mode, the rotor and pipe handler are conventionally rotated by the handler rotate.
Figure 22:
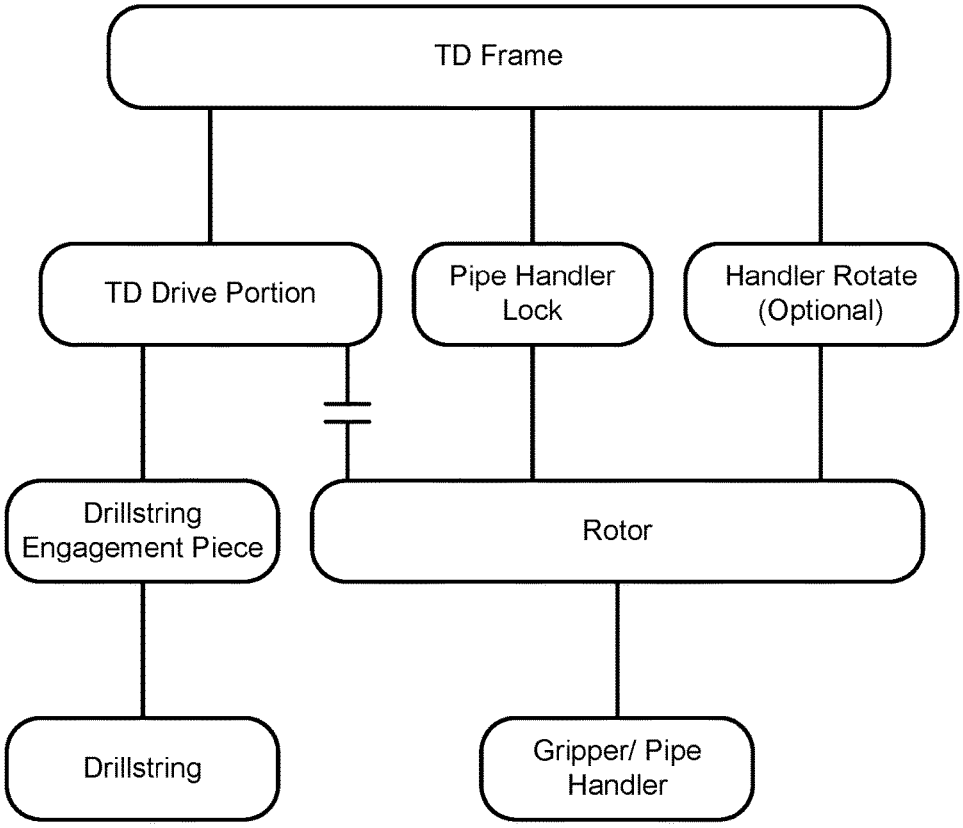
FIG. 22 is a diagrammatic illustration of an embodiment, such as depicted in FIG. 15, wherein, in normal mode, the rotor and pipe handler are locked so as to prevent their rotation.

For the above described embodiment employing ICD plate 10, FIG. 18 diagrammatically shows the normal mode of operation of the TD and pipe handler, that is, where rotation of the TD main sprocket does not rotate the gripper gripping the casing tubular. Conversely, FIG. 19 diagrammatically shows the ICD mode of operation where rotation of the TD main sprocket does rotate the gripper and consequently rotates the casing tubular. In both FIGS. 18 and 19 directional arrows indicate the transmission of energy to the rotor via the REC, and dotted lines indicate a non-connection between respectively the main sprocket and the ICD plate in FIG. 18, and the TD frame and the ICD plate in FIG. 19. In FIG. 19 the split path between the ICD plate and the rotor indicate the normal mode options of using the pipe handler rotation drive and the pipe handler lock.

A second embodiment of the invention employs a spur gear for pipe handler rotation and ICD locking members on the rotor which lock to the rotary drive portionin the ICD mode of the MSM. As seen in FIGS. 5-15, which again are not intended to be limiting, the ICD lock locks to the spindle 26, as described better below. In particular, the ICD lock selectively locks rotor 20 to spindle 26 when in ICD mode. A pipe handler lock selectively locks rotation of the pipe handler. so as to lock rotation of the rotor, pipe handler, and gripper, when in normal mode. Thus as seen in FIGS. 12-15 respectively, when the ICD lock is engaged, i.e. in ICD mode, the pipe handler lock may be locked or unlocked (the latter for operation of the ICD), and when the ICD lock is dis-engaged, i.e. in normal mode, the pipe handler lock may be unlocked (for pipe handling) or locked.

As before, main sprocket 12 is driven by the top drive drive motors 40 so as to conventionally drive the rotation of spindle 26. In the illustrated embodiment, main sprocket 12 is driven by a plurality of drive motors 40 and corresponding gear reducers, mounted on drive plate 42. Drive plate 42 forms part of the top drive frame. Two drive motors 40 are illustrated, it being understood that in the illustrated embodiment, four such drive motors 40 and the corresponding gear reducers may be mounted on drive frame plate 42. Drive motors 40 and the corresponding gear reducers, drive the rotation of the corresponding main drive gears 44 so as to drive the rotation of main sprocket 12 for example by means of a drive belt (not shown).

Stator 14 is mounted underneath drive sprocket 12. Stator 14 is rigidly mounted to the top drive frame. At least two rigid bridge-pieces 46 are mounted between drive plate 42 and stator 14 so as to maintain stator 14 rigidly parallel with and spaced from top drive plate 42. Thus a pair of bridge-pieces 46, such as in the illustrated embodiment, will maintain the positioning and alignment of stator 14 relative to top drive frame plate 42, thereby sandwiching main sprocket 12 for rotation therebetween.

Spur-gear 48 is rigidly mounted to rotor 20 for rotation therewith. Spur gear 48 and rotor 20 rotate about the longitudinally extending centre-line axis A of spindle 26. As before, conventionally pipe handler 22 includes gripper 24 and is mounted to rotor 20, although not shown in this illustrated embodiment. Thus in the normal mode of operation of. the top drive and pipe handler, rotor 20 is rotated in direction B by the selective operation of at least one pinion gear 50.

Pinion gear 50 is driven by drive motor 52 via drive shaft 50*a*, which rotates drive shaft 54. Drive shaft 54 extends from drive motor 52, through bores in the corresponding bridge-piece 46, so as to engage its corresponding pinion gear 50. In the TD normal mode, pinion gear 50 selectively rotates rotor 20 and thereby also selectively rotates pipe handler 22 and gripper 24. When the TD is in ICD mode, pinion gear 50 is free-wheeling, or may be disengaged from its engagement with spur gear 48. A toothed locking segment, which may be characterized as a locking dog, is mounted to stator 14 and is actuable so as to engage spur gear 48. In the TD normal mode toothed locking segment 56 may be engaged, for example locked, with spur gear 48 or may be lowered or otherwise disengaged so as to be out of mating engagement with teeth 48*a* on spur-gear 48 for re-orienting of the pipe handler. By way of example, locking segment 56 may be actuated into, and out of, engagement with the teeth 48*a* of spur-gear 48, by an elongate actuating member such as a linearly driven shaft (not shown) or by a rotatably driven jack screw 58. Lock actuating jack screw 58 may be driven by a corresponding drive motor 60. Thus in the illustrated embodiment, locking segment 56 locks and unlocks from engagement with spur-gear 48 by being actuated in direction C, parallel to centreline axis A. In the illustrated embodiment which, again, is only intended to show one example of many mechanisms which may be employed to lock rotation of rotor 20, locking segment 56 is guided during its translation in direction C by guide dowels 62. In FIGS. 5-8, locking segment 56 is illustrated in the locked (elevated) position thereby locking rotor 20 to stator 14. Guide dowels 62 pass through corresponding apertures 62*a* in stator 14.

In normal mode, locking segment 56 may be lowered and thereby unlocked from spur-gear 48, rotation of pipe handler 22 may be accomplished in the conventional fashion by the actuation of drive motor 52 driving pinion 50. Thus, in normal mode, rotation of pipe handler 22 may be accomplished independently of rotation of main sprocket 12 and its corresponding rotation of spindle 26.

When in ICD mode, rotor 20 is locked to spindle 26 by means of at least one ICD locking member 64, for example radial locking pins or shafts or shear beams which may include load bearing cells; for example commercially available load measurement transducers. Although it is understood that rotor 20 may be locked to any part of the rotary drive portion including the spindle, quill, main drive, sprocket, bull gear, or attachments thereto, in the illustrated embodiment each ICD locking member actuates radially inwardly and outwardly of centreline axis A through a corresponding aperture 26*a* in the sidewall of spindle 26. In the illustrated embodiment, again which is not is intended to be limiting, an oppositely radially disposed pair of locking members 64 lock and unlock from engagement with spindle 26 by translation radially of centreline axis A in direction D. In the illustrated example where the locking members 64 are shear beam load cells, the shear beam load cells translate relative to housings 66. Housings 66 are mounted to rotor 20. Thus in ICD mode, rotor 20 is locked to the rotation of spindle 26 by the manual, or remote, or automated actuation of locking members 64. Note that the load cell need not be in the locking device itself; but can be anywhere in the rotational transmission between the rotary drive portion and the rotor, and foreseeably anywhere between the rotary drive portion and the gripper.

In this embodiment stator 14 is fixed to the TD frame at all times. A slewing bearing allows rotation of the rotor plate 20 relative to the stator plate 14 (i.e. Rz as conventionally defined is free) but fixes the rotor plate 20 to the stator plate 14 with respect to the other five degrees of freedom as conventionally defined (X, Y, Rx, Ry). The slewing bearing may for example be a Kaydon Bearings™ Model RK6, which is a ball bearing design. The inner race is fixed to the stator plate. The outer race is fixed to the rotor. The outer race is geared, for active pipe handler rotation for example by motor 52 and pinion 50 mounted on the TD frame or stator plate.

Variations on the use of the slewing bearings may include: roller bearing or dry sliding bearing, double/triple/quad bearing, sealed or not, outer fixed to stator, inner fixed to rotor, internally geared, not geared at all (could have no handler rotate function), separate gear fixed to either race, handler rotate motor/pinion mounted on the pipe handler, rotor could be rotationally mounted to the spindle/quill instead of to the rotor.

The rotor is the mounting platform for the rotatable pipe handler, and is fixed to the outer race of the slewing bearing (or could be inverted; as per the above variations).

Other optional pipe handler rotate motor/pinion arrangements may include:

a) Handler rotate motor fixed to the TD frame or stator plate.
b) Pinion mounted to, coupled to or driven by the pipe handler rotate (HR) motor and engaged to, so as to drive the slew bearing spur gear and hence the rotor.
c) Motor may be a gearmotor, i.e., it may include gear reduction.
d) Motor may be electric, hydraulic, pneumatic or other.
e) Provisions to de-couple the pinion from the motor or remove the pinion, for speed considerations in ICD mode (handler rotate) function geared for 2-3 RPM pipe handler speed, ICD 10-30 RPM, hack-drive during ICD may turn the motor or reducer too fast).
f) Redundancy and symmetry (illustrated embodiment shows two HR pinions 50) but there could be any number (only constrained by available space), including zero.
g) They are as illustrated at the sides of the TD but they could be in any plan-view orientation.
h) The HR motor(s) may assist or entirely perform the handler lock function by braking the motor(s).

The pipe handler lock may be an internally toothed locking dog or segment 56 mounted to the stator wherein segment 56 may be axially displaced to selectively engage the spur-gear 48 in the slewing bearing. It may be actuated by a screw 58 driven by an electric motor 60 with a gear reducer, mounted on the TD frame/stator (42,14). Two may be preferred for redundancy and symmetry; but there could be any number as constrained by available space, and they could be in any plan-view orientation. Actuation could be hydraulic, pneumatic, etc or even manual.

Each preferably has a sensor to verify the proper locked position, for example a limit switch or proximity sensor. The ICD lock mechanism of the MSM could also be mounted/actuated on the rotor so as to lock against the stator. There exist many possible variations: pin(s) in a vertical axis engaging the rotor and stator (or extensions of same); pin(s) in a horizontal axis engaging the rotor and stator (or extensions of same); pins(s) of any shape in any other orientation engaging the rotor and stator (or extensions of same); bolted connection (bolts in any orientation); jaw clutch; plate clutch; drum clutch; a selectively engageable spline (spline can be any polygon, ie, not a circle); a wedge or cam lock; an indirect lock, eg, lock pinion which is geared (or chained or belted) to the rotor stator.

The ICD lock may include pins mounted to the rotor which may be selectively radially or otherwise displaced to engage the rotary drive portion. The rotor and pipe handler are thereby rotationally coupled to the rotary drive portion of the TD.

A pair of ICD locks may be used for load balance; but there could be any number as constrained by available space. The pins may be shear beam load cells to measure the ICD torque. Actuation may be manual or remote controlled (e.g. hydraulic, electric, pneumatic). The ICD lock could engage anything attached to the rotary drive portion, e.g. the spindle, quill, main drive sprocket or bull gear. There are many possible variations, again including: Pin(s) in a vertical axis engaging the bull gear or sprocket; Pin(s) in a horizontal axis engaging the spindle or quill; Pin(s) of any shape in any other orientation engaging the rotary drive portion; Bolted connection (bolts in any orientation); Jaw clutch; Plate clutch; Drum clutch; A selectively engageable spline (spline can be any polygon, ie, not a circle); A wedge or cam lock; An indirect lock, eg, lock a pinion which is geared (or chained or belted) to the rotary drive portion; Other load cell types and mounting configurations.

Actuations of the ICD lock is manual in the basic case. An operator pushes the locking member (pin, shaft, load cell) in and out of ICD mode by hand, and may install a pin, latch or other retainer in either position. A screw could be used for manual actuation.

Remote controlled actuation is optional, by hydraulic or pneumatic cylinder electric actuator, etc. A cylinder and rod may connect between the load cell pin and an angle, block, or housing 66 on the rotor plate.

The use of load cells is optional as one could rely entirely on the TD's torque instrumentation.

Figure 13:
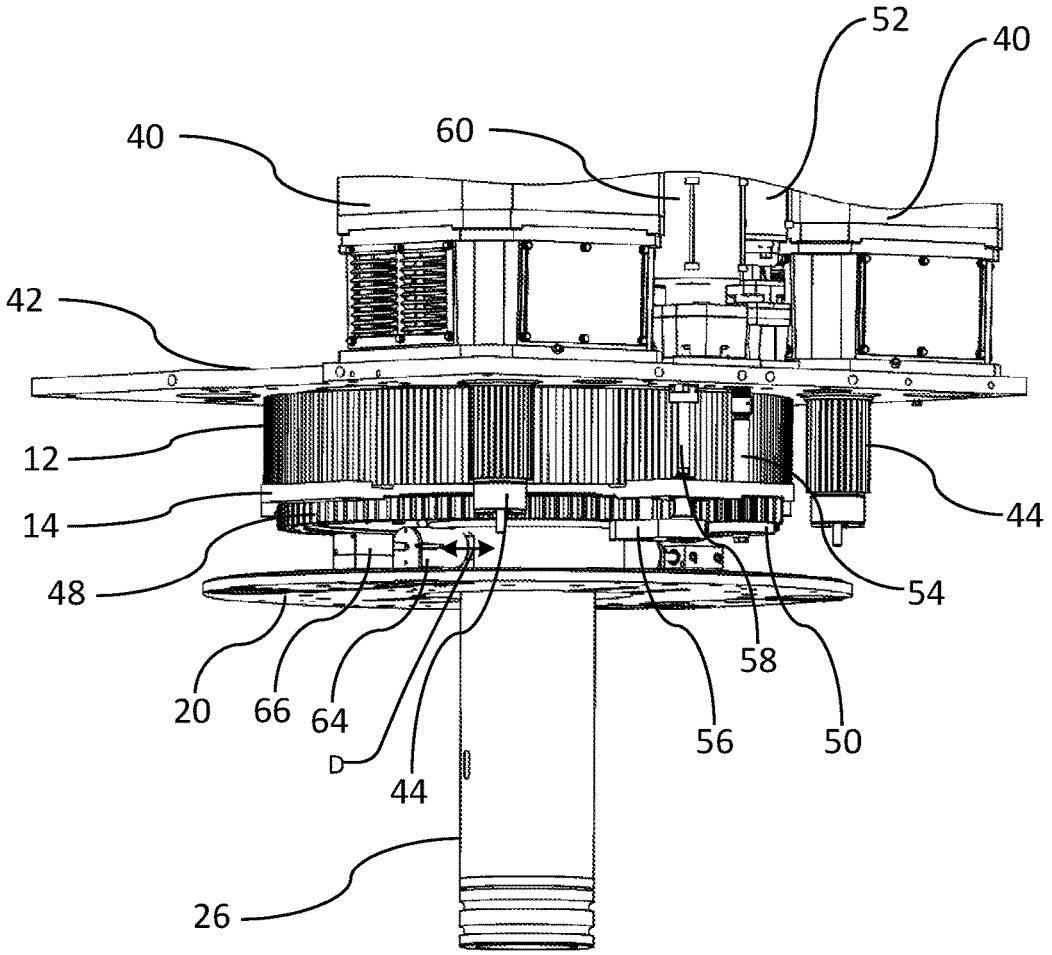
FIG. 13 is the top drive and integrated casing drive of FIG. 12 with the ICD lock in ICD mode and wherein the pipe handler rotate (HR) locking dog is unlocked from the pipe handler spur-gear.
Figure 14:
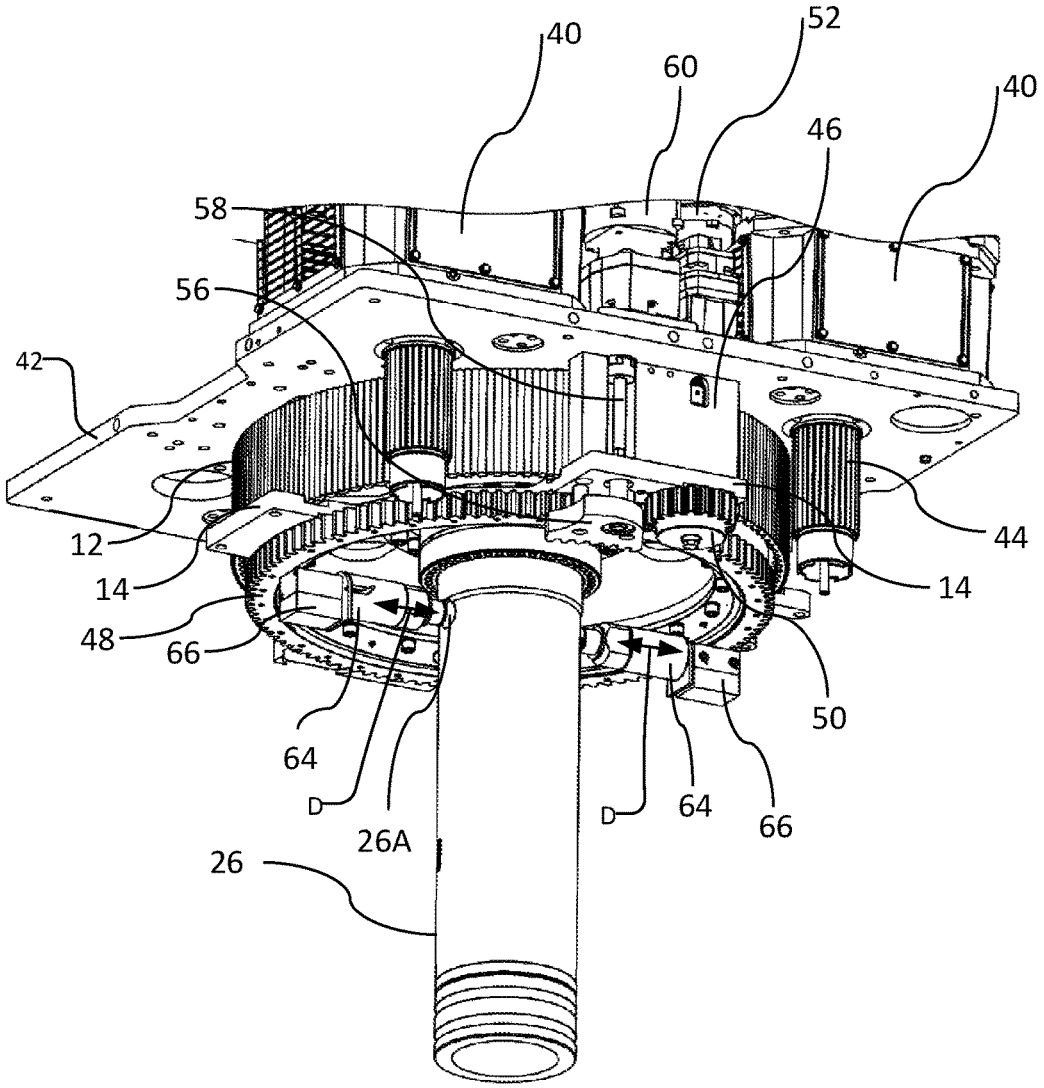
FIG. 14 is the top drive and integrated casing drive of FIG. 13 wherein the ICD lock is in normal mode so as to unlock the rotor from the spindle and wherein the HR locking dog is unlocked from the spur-gear.
Figure 15:
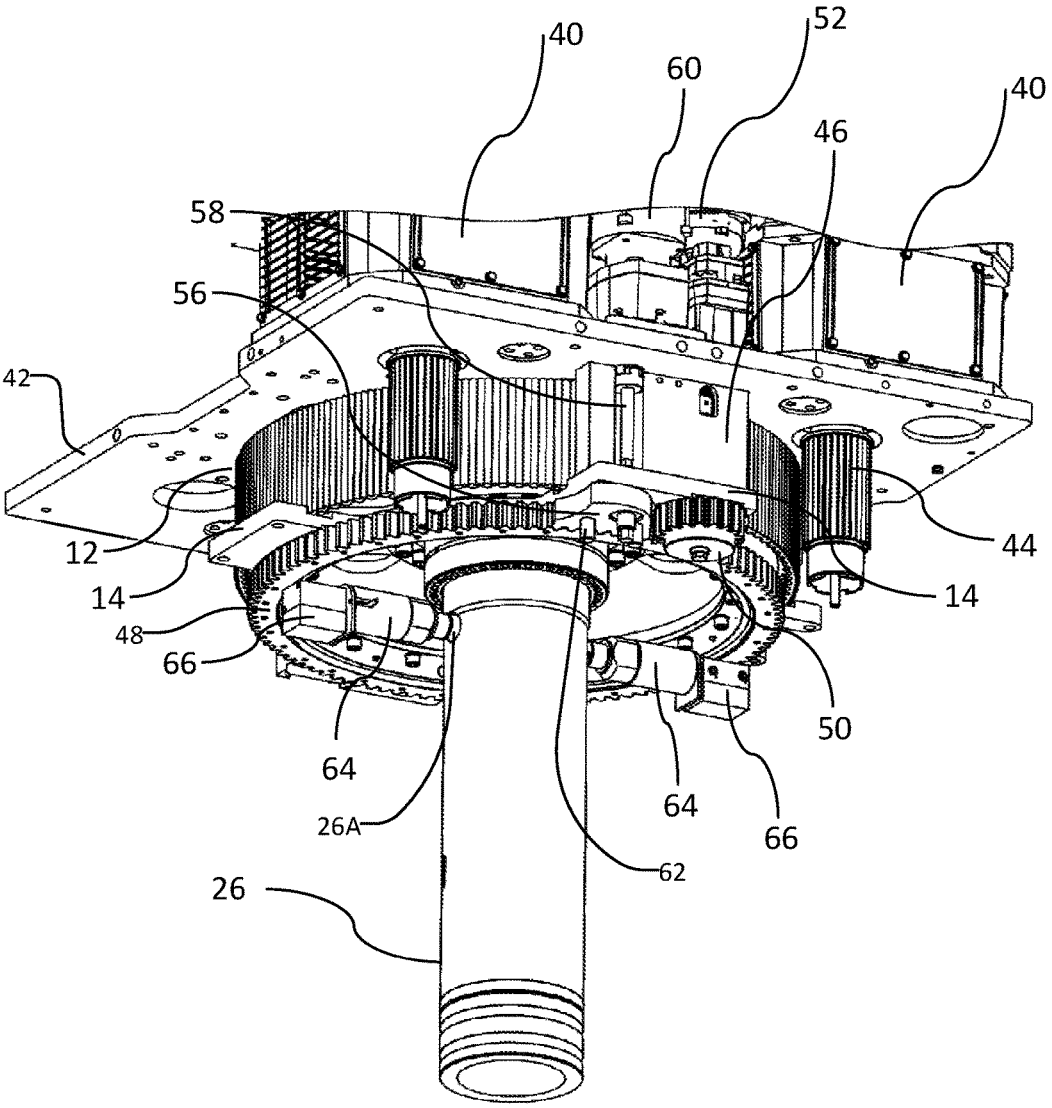
FIG. 15 is the top drive and integrated casing drive of FIG. 14 wherein the ICD lock is in its normal mode and wherein the HR locking dog is in its locked position locking the pipe handler spur-gear.

To summarize, and as may be determined from viewing FIGS. 13-15, there are four operating modes:

1. Normal drilling/tripping (FIG. 15)—Handler locked, ICD disengaged, HR motor(s) idle. The pipe handler is rotationally fixed to the TD frame. Tubular connection torque from a backup wrench or gripper may be reacted from the rotor to the TD frame via the handler lock. Torques may be quite high, eg. 75,000 ft-lb.

2. Handler Rotate (HR) for adjusting the pipe handler orientation for normal drilling/tripping operations (FIG. 14)—Handler unlocked, ICD disengaged, HR motor(s) actuated.

3. Handler Freewheel (FIG. 14)—Optional, may be useful for some tripping operations or during service—Handler unlocked, ICD disengaged, HR motor(s) idle.

4. Integrated Casing Drive (FIG. 13)—Handler Unlocked, ICD engaged, HR motors idle or de-coupled. The pipe handler (including gripper) is rotationally fixed to the TD rotary drive portion(spindle/quill/sprocket/bull gear) and the gripper is then used to rotate casing without screwing into it.

Disconnecting pinion 50 from spur gear 48 may be advisable when in ICD mode as the back-drive speed of the pinion may exceed the limits of the reducer and/or the motor. For example operating the ICD at 20 RPM may equate to 20,000 RPM or more at the pipe handler rotate (HR) motor. Further, the frictional resistance of the motor(s) and reducer (s) may distort the torque measurement from any load cells. Consequently, one embodiment includes provisions to de-couple between the pinion and the motor's gear reducer when in ICD mode. For example a female spline coupling may be used to vertically disengage the pinion shaft. A spring may be used to hold the female spline coupling down in the normal working position and help re-engage if the spline teeth are not initially aligned.

Alternatively, any of the pinion 50, the HR motor, the HR reducer, or the HR connecting shaft may be entirely removed when in ICD mode to accomplish the HR de-coupling.

Disconnecting pinion 50 may not be needed if larger HR motors are used so the reducer ratio may be lower, or if lower HR torque in normal operations is acceptable, or if the maximum ICD speed is reduced, or if the frictional resistance of the HR motors and reducers is approximately constant, so one could offset for it in the ICD torque calculation. For example, using two ¾ HP handler rotate motors, a 43.3:1 reducer ratio, 15 RPM maximum (max) ICD speed, 1839 ft-lb max HR torque, then the max ICD backdrive motor speed would be 4203 RPM, which would likely be acceptable.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A top drive having an integrated casing drive, the top drive comprising:

a top drive frame, a selectively driven drive system, supported by said top drive frame, having a rotationally driven rotary drive portion including a drill string engagement piece, a rotor rotationally mounted in cooperation with, for selective rotation when in a normal operating mode relative to, said top drive frame and said rotary drive portion, a pipe handler and corresponding gripper mounted on said rotor, a mode-shift mechanism cooperating with said drive system and said rotor, wherein said mode-shift mechanism selectively switches between said normal operating mode and a casing-drive mode wherein said mode shift mechanism includes at least one lock including a selectively engageable casing drive lock, the casing drive lock engageable between said rotor and said rotary drive portion, so as to lock rotation of said rotor relative to said rotary drive portion when said mode shift mechanism is in said casing-drive mode, in said casing drive mode, said rotor is fixed by said mode-shifting mechanism so as to be substantially in a fixed rotational position relative to, for rotation with, said rotary drive portion of said drive system; and a stator mounted to said top drive frame, whereby, in said casing-drive mode, a tubular such as a casing tubular, held in the gripper is rotated by rotation of said rotary drive portion of said drive system and wherein said at least one lock is selectively actuable to lock said rotor to said stator or to said top drive frame when in said normal operating mode, and wherein said at least one lock is selectively actuable to lock said rotor to said rotary drive portion when in said casing-drive mode.

2. The top drive of claim 1 wherein said mode shift mechanism includes a casing drive plate cooperating with said rotor and said rotary drive portion, and wherein said casing drive lock is mounted for cooperation with said casing drive plate.

3. The top drive of claim 2 wherein said pipe handler is mounted to said rotor for rotation relative to said top drive frame, and wherein said top drive further comprises a rotatable energy-coupling cooperating with said rotor and said pipe handler whereby energy for powering said gripper is transferred to said gripper.

4. The top drive of claim 1 wherein said top drive further comprises a rotatable energy-coupling cooperating with said rotor and said pipe handler whereby energy for powering said gripper is transferred to said pipe handler.

5. The top drive of claim 4 wherein, in said casing-drive mode, said pipe handler is locked relative to said rotary drive portion by a casing drive lock.

6. The top drive of claim 4 wherein said rotatable energy coupling is chosen from the group comprising: slip rings, a rotary union, a rotary manifold, an inductive coupling, an SPT coupling.

7. The top drive of claim 4 wherein said rotatable energy coupling is a rotating coupling transmitting energy via a fluid.

8. The top drive of claim 1 wherein, in said casing-drive mode, said pipe handler is locked relative to said rotary drive portion by a plurality of said casing drive locks.

9. The top drive of claim 1 wherein said rotary drive portion is chosen from the group comprising: a drive sprocket, a bull gear, a spindle, a quill, a shaft, and wherein said casing drive lock locks to said rotary drive portion.

10. The top drive of claim 1 wherein said casing drive plate cooperates functionally between said rotor and said stator.

11. The top drive according to claim 1 wherein said mode-shift mechanism comprises a pipe handler lock selectively operable to couple the rotor to the top drive frame such that the rotor and pipe handler cannot be rotated relative to the top drive frame.

12. The top drive according to claim 1 wherein the mode-shift mechanism comprises a pin oriented radially relative to the rotary drive portion, the pin radially movable to engage the rotary drive portion.

13. The top drive according to claim 1 wherein the mode-shift mechanism comprises a pin oriented axially relative to the rotary drive portion, the pin axially movable to engage the rotary drive portion.

14. The top drive according to claim 1 wherein the main motor of the top drive is automatically controlled to limit one or both of speed and torque when the mode-shift mechanism is in said casing drive mode.

15. The top drive according to claim 1 comprising a pipe handler rotate motor, the pipe handler rotate motor coupled to drive rotation of the rotor relative to the top drive frame by a mechanism that permits the pipe handler rotate motor to be decoupled from the rotor when the mode-shift mechanism is in said casing drive mode.

16. The top drive according to claim 1 comprising a pipe handler rotate motor separate from the drive system, the pipe handler rotate motor coupled to drive rotation of the rotor, and a brake operable to brake the pipe handler rotate motor.

17. The top drive according to claim 1 comprising a pipe handler rotate motor separate from the drive system, the pipe handler rotate motor coupled to drive rotation of the rotor relative to the top drive frame, wherein the pipe handler rotate motor is connected to freewheel when the mode-shift mechanism is in the casing drive mode and the rotary drive portion is rotated.

18. The top drive according to claim 1 wherein the gripper is mounted for axial float relative to the top drive frame.

19. An integrated casing drive system comprising:

a top drive having a rotary drive portion and a top drive frame, a stator mounted to said top drive frame and a rotor rotationally mounted to the stator, a pipe handler having a gripper wherein said pipe handler is mounted to said rotor, at least one lock including a casing drive selectively actuable to lock said rotary drive portion to said pipe handler, whereby, in a casing-drive mode, a tubular such as a casing tubular, held in the gripper is rotated by rotation of said rotary drive portion of said drive system and wherein said at least one lock is selectively actuable to lock said rotor to said stator or to said top drive frame when in said normal operating mode, and wherein said at least one lock is selectively actuable to lock said rotor to said rotary drive portion when in said casing-drive mode.

20. The integrated casing drive according to claim 19 wherein said at least one lock comprises a pipe handler lock selectively operable to couple the rotor to the top drive frame such that the rotor and pipe handler cannot be rotated relative to the top drive frame.

21. The integrated casing drive according to claim 19 wherein the at least one lock comprises a pin oriented radially relative to the rotary drive portion, the pin radially movable to engage the rotary drive portion.

22. The integrated casing drive according to claim 19 wherein the at least one lock comprises a pin oriented axially relative to the rotary drive portion, the pin axially movable to engage the rotary drive portion.

23. The integrated casing drive according to claim 19 wherein a main motor of the top drive is automatically controlled to limit one or both of speed and torque when the at least one lock is actuated to lock the rotor to the rotary drive portion.

24. The integrated casing drive according to claim 19 comprising a pipe handler rotate motor, the pipe handler rotate motor coupled to drive rotation of the rotor relative to the top drive frame by a mechanism that permits the pipe handler rotate motor to be decoupled from the rotor when the at least one lock is actuated to lock the rotor to the rotary drive portion.

25. The integrated casing drive according to claim 19 comprising a pipe handler rotate motor separate from the main drive, the pipe handler rotate motor coupled to drive rotation of the rotor, and a brake operable to brake the pipe handler rotate motor.

26. The integrated casing drive according to claim 19 comprising a pipe handler rotate motor separate from the main drive, the pipe handler rotate motor coupled to drive rotation of the rotor relative to the top drive frame, wherein the pipe handler rotate motor is connected to freewheel when the at least one lock is actuated to lock the rotor to the rotary drive portion and the rotary drive portion is rotated.

27. The integrated casing drive according to claim 19 wherein the gripper is mounted for axial float relative to the top drive frame.

28. A method for rotating a casing string, the method comprising:

providing a top drive having a main rotary drive connected to drive rotation of a rotary drive portion, a pipe handler having a gripper wherein said pipe handler is rotationally mounted to said top drive, a selectively actuable casing drive lock operable to lock said rotary drive portion to said pipe handler and elevators suspended from the top drive below the gripper and rotatable relative to the top drive, gripping a tubular at an upper end of the casing string in said gripper while supporting a weight of the casing string by the elevators, and locking said rotary drive portion to said pipe handler by actuating said casing drive lock and rotating said tubular by operating the main rotary drive to rotate said rotary drive portion so as to rotate said pipe handler and gripper such that the gripper, casing string and elevators rotate in unison.

29. A method according to claim 28 wherein: the rotary drive portion comprises a main shaft and a main sprocket or bull gear attached to the main shaft; the main drive comprises one or more drive motors operable to drive the main sprocket or bull gear; the pipe handler comprises a rotor; and locking said rotary drive portion to said pipe handler by actuating said casing drive lock comprises engaging pins between the main sprocket or bull gear and the rotor.

30. The method according to claim 28 wherein: the rotary drive portion comprises a main shaft and a main sprocket or bull gear attached to the main shaft; the top drive comprises a handler rotate motor separate from the main drive; the handler rotate motor connected to turn the pipe handler relative to the top drive; wherein and locking said rotary drive portion to said pipe handler comprises braking the handler rotate motor.

31. A top drive having an integrated casing drive, the top drive comprising:

a top drive frame, a selectively driven drive system, supported by said top drive frame, having a rotationally driven rotary drive portion including a drill string engagement piece, a rotor rotationally mounted in cooperation with, for selective rotation when in a normal operating mode relative to, said top drive frame and said rotary drive portion, a pipe handler and corresponding gripper mounted on said rotor, a mode-shift mechanism cooperating with said drive system and said rotor, wherein said mode-shift mechanism selectively switches between said normal operating mode and a casing-drive mode wherein, in said casing drive mode, said rotor is fixed by said mode-shifting mechanism so as to be substantially in a fixed rotational position relative to, for rotation with, said rotary drive portion of said drive system, whereby, in said casing-drive mode, a tubular such as a casing tubular, held in the gripper is rotated by rotation of said rotary drive portion of said drive system, wherein said mode shift mechanism includes a selectively engageable casing drive lock engageable between said rotor and a spindle, shaft, quill, drive sprocket or bull gear of said rotary drive portion so as to lock rotation of said rotor relative to said rotary drive portion when said mode shift mechanism is in said casing-drive mode; and wherein said casing drive lock includes a shear beam load cell as a locking member thereof.

32. A top drive comprising:

a frame, a rotary drive portion supported by the frame and rotatable relative to the frame about an axis, the rotary drive portion threaded to engage a drill string;

a main drive coupled to drive rotation of the rotary drive portion;

a rotor coupled to the frame for rotation about the axis;

a pipe handler comprising a gripper suspended from the rotor;

a locking member carried by the rotor, the locking member selectively operable to:

couple the rotor to the rotary drive portion or another member driven by the main drive such that the main drive is coupled to drive the rotor and pipe handler to rotate about the axis; or uncouple the rotor from the rotary drive portion or the other member such that the main drive can be operated to turn the rotary drive portion while the rotor and pipe handler do not rotate about the axis;

wherein the locking member comprises a shear beam load cell.

33. The top drive according to claim 32 comprising a pipe handler lock selectively engageable to couple the rotor to the frame such that the rotor and pipe handler cannot be rotated about the axis when the pipe handler lock is engaged.

34. The top drive according to claim 32 wherein the locking member comprises a pin oriented radially relative to the rotary drive portion, the pin radially movable to engage a recess in the rotary drive portion.

35. The top drive according to claim 32 wherein the locking member comprises a pin oriented axially relative to the rotary drive portion, the pin axially movable to engage a recess in the rotary drive portion.

36. The top drive according to claim 32 wherein the main motor is automatically controlled to limit one or both of speed and torque when the locking member is positioned to couple the rotor to the rotary drive portion or the other member.

37. The top drive according to claim 32 comprising a pipe handler rotate motor separate from the main drive, the pipe handler rotate motor coupled to drive rotation of the rotor by a mechanism that permits the pipe handler rotate motor to be decoupled from the rotor when the locking member is positioned to couple the rotor to the rotary drive portion or the other member.

38. The top drive according to claim 32 comprising a pipe handler rotate motor separate from the main drive, the pipe handler rotate motor coupled to drive rotation of the rotor, and a brake operable to brake the pipe handler rotate motor.

39. A top drive comprising:

a frame, a rotary drive portion supported by the frame and rotatable relative to the frame about an axis, the rotary drive portion comprising a main shaft and a main sprocket or bull gear attached to the main shaft;

a main drive comprising one or more drive motors operable to drive the rotary drive portion by way of the main sprocket or bull gear;

a rotor coupled to the frame for rotation about the axis;

a gripper supported by the rotor;

a locking mechanism carried by the rotor, the locking mechanism selectively operable to:

couple the rotor to the main sprocket or bull gear such that the main motor is coupled to drive the rotor and gripper to rotate about the axis or uncouple the rotor from the main sprocket or bull gear such that the main motor can be operated to turn the rotary drive portion while the rotor and gripper do not rotate about the axis; and a pipe handler rotate motor separate from the main drive, the pipe handler rotate motor coupled to drive rotation of the rotor by a mechanism that permits the pipe handler rotate motor to be decoupled from the rotor when the locking mechanism is operated to couple the rotor to the main sprocket or bull gear;

wherein the locking mechanism comprises pins engageable between the main sprocket or bull gear and the rotor.

40. A top drive comprising:

a frame, a rotary drive portion supported by the frame and rotatable relative to the frame about an axis, the rotary drive portion comprising a main shaft and a main sprocket or bull gear attached to the main shaft;

a main drive comprising one or more drive motors operable to drive the rotary drive portion by way of the main sprocket or bull gear;

a rotor coupled to the frame for rotation about the axis;

a gripper supported by the rotor;

a locking mechanism carried by the rotor, the locking mechanism selectively operable to:

couple the rotor to the main sprocket or bull gear such that the main motor is coupled to drive the rotor and gripper to rotate about the axis or uncouple the rotor from the main sprocket or bull gear such that the main motor can be operated to turn the rotary drive portion while the rotor and gripper do not rotate about the axis; and a pipe handler rotate motor separate from the main drive, the pipe handler rotate motor coupled to drive rotation of the rotor, and a brake operable to brake the pipe handler rotate motor;

wherein the locking mechanism comprises pins engageable between the main sprocket or bull gear and the rotor.

41. A top drive comprising:

a frame, a rotary drive portion supported by the frame and rotatable relative to the frame about an axis, the rotary drive portion comprising a main shaft and a main sprocket or bull gear attached to the main shaft;

a main drive comprising one or more drive motors operable to drive the rotary drive portion by way of the main sprocket or bull gear;

a rotor coupled to the frame for rotation about the axis;

a gripper supported by the rotor;

a locking mechanism carried by the rotor, the locking mechanism selectively operable to:

couple the rotor to the main sprocket or bull gear such that the main motor is coupled to drive the rotor and gripper to rotate about the axis or uncouple the rotor from the main sprocket or bull gear such that the main motor can be operated to turn the rotary drive portion while the rotor and gripper do not rotate about the axis; and a pipe handler rotate motor separate from the main drive, the pipe handler rotate motor coupled to drive rotation of the rotor relative to the top drive frame, wherein the pipe handler rotate motor is connected to freewheel when the locking mechanism is operated to couple the rotor to the main sprocket or bull gear and the main sprocket or bull gear is rotated;

wherein the locking mechanism comprises pins engageable between the main sprocket or bull gear and the rotor.

* * * * *